US008684796B2

(12) United States Patent
McCutchen et al.

(10) Patent No.: US 8,684,796 B2
(45) Date of Patent: Apr. 1, 2014

(54) FLOOR GRINDING AND POLISHING MACHINE

(75) Inventors: Travis McCutchen, Owasso, OK (US); Clinton McCutchen, Tulsa, OK (US); Radu Stingu, Dearborn Heights, MI (US)

(73) Assignee: KRMC, LLC, Romulus, MI (US)

( * ) Notice: Subject to any disclaimer, the term of this patent is extended or adjusted under 35 U.S.C. 154(b) by 165 days.

(21) Appl. No.: 13/252,771

(22) Filed: Oct. 4, 2011

(65) Prior Publication Data

US 2013/0084782 A1 Apr. 4, 2013

(51) Int. Cl.
*B24B 23/00* (2006.01)

(52) U.S. Cl.
USPC ..... 451/57; 451/58; 451/350; 451/353

(58) Field of Classification Search
USPC ..... 451/28, 57, 58, 350, 353, 359; 15/48.1
See application file for complete search history.

(56) References Cited

U.S. PATENT DOCUMENTS

| | | | | |
|---|---|---|---|---|
| 3,277,511 | A | 10/1966 | Little et al. | |
| 4,273,384 | A * | 6/1981 | Freeburn | 299/41.1 |
| 4,709,510 | A * | 12/1987 | Giovanni et al. | 451/353 |
| 4,719,659 | A * | 1/1988 | Urakami | 15/49.1 |
| 5,070,656 | A | 12/1991 | Brogden | |
| 5,439,413 | A | 8/1995 | Lagler | |
| 5,637,032 | A | 6/1997 | Thysell et al. | |
| 6,315,648 | B1 * | 11/2001 | Neer | 451/92 |
| 6,331,138 | B1 | 12/2001 | Witters | |
| 6,540,596 | B1 | 4/2003 | Van Der Veen | |
| D519,530 | S | 4/2006 | Thysell et al. | |
| D522,543 | S | 6/2006 | Thysell et al. | |
| 7,140,957 | B2 * | 11/2006 | Thysell et al. | 451/350 |
| 7,226,347 | B1 | 6/2007 | Padgett et al. | |
| 7,241,210 | B2 | 7/2007 | Van Vliet | |
| 7,261,623 | B1 * | 8/2007 | Palushi | 451/350 |
| 7,326,106 | B1 * | 2/2008 | Rogers et al. | 451/350 |

(Continued)

FOREIGN PATENT DOCUMENTS

| | | |
|---|---|---|
| EP | 0 189 617 A2 | 8/1986 |
| EP | 1 970 160 A1 | 9/2008 |

OTHER PUBLICATIONS

Kut-Rite, Conquer 20, Owner's Manual/Operating Instructions; dated Apr. 4, 2011; 25 pages.

(Continued)

*Primary Examiner* — Eileen P. Morgan
(74) *Attorney, Agent, or Firm* — Howard & Howard Attorneys PLLC

(57) ABSTRACT

A floor grinding and polishing machine including a base that includes a shroud, and first and second spindle carriers rotatably coupled thereto which have first and second axes of rotation spaced from each other in an alignment direction. The base also includes first and second pluralities of rotatable spindles, each plurality carried by a spindle carrier and distributed about the respective spindle carrier axis of rotation. Motors are connected to the shroud and drivingly engaged with the pluralities of spindles, whereby each plurality of spindles is rotatably driven about its respective spindle axis of rotation. The machine also includes floor-engaging handle coupled to the base and defining a direction of operative movement along which the machine may linearly travel. The base and handle have different first and second selective, relative positions in which the alignment and operative movement direction have substantially different relative angular positions.

20 Claims, 17 Drawing Sheets

(56) References Cited

U.S. PATENT DOCUMENTS

| | | | | |
|---|---|---|---|---|
| 7,393,267 | B2 * | 7/2008 | Dummermuth-Furter | 451/353 |
| 8,172,649 | B2 * | 5/2012 | Mann et al. | 451/353 |
| D662,523 | S * | 6/2012 | Goentzel | D15/27 |
| 8,282,445 | B2 * | 10/2012 | Goldberg et al. | 451/353 |
| 8,393,937 | B2 * | 3/2013 | Goldberg et al. | 451/353 |
| 2005/0054279 | A1 * | 3/2005 | Jordan | 451/350 |
| 2005/0250422 | A1 | 11/2005 | Thysell | |
| 2007/0178999 | A1 * | 8/2007 | Wilson et al. | 474/87 |
| 2008/0108286 | A1 | 5/2008 | Thysell et al. | |
| 2009/0019652 | A1 | 1/2009 | Goldberg | |

OTHER PUBLICATIONS

Kut-Rite, Product Brochure; undated, published prior to Oct. 4, 2011, 40 pages.

Written Opinion and International Search Report for Application No. PCT/US12/000480 dated Jul. 17, 2013, 9 pages.

* cited by examiner

F

FLOOR GRINDING AND POLISHING MACHINE

BACKGROUND OF THE INVENTION

1. Field of the Invention

The present invention generally relates to apparatuses used for floor finishing, particularly floor grinding and polishing, and more particularly to concrete floor grinding and polishing machines.

2. Description of the Related Art

Polished concrete has made tremendous growth over the past decade and is a result of taking what is a traditional building product (i.e., concrete flooring) and making it an attractive floor finish. It provides a wide spectrum of varying color choices and surface finishes. Grinding and polishing concrete (also referred to herein as polishing concrete) is a true mechanical process which does not require a film-forming membrane and should not be confused with sealed concrete.

Typically the concrete goes through a process of grinding and polishing using aggressive equipment and abrasive elements or tooling, including abrasive pads of varying grits from 30 to 3,000. The pads are drivably supported on a plurality of rotatable spindle pads driven by a machine-mounted electric motor. The process may utilize a concrete hardener that enables the concrete to chemically alter itself into a much more dense and liquid-resistant surface, and may yield a mirror finish on the surface of the concrete slab.

Oftentimes existing concrete floors with years of old and otherwise failing floor covering can be turned into an attractive functional floor having a total life, with proper maintenance, that will outlast other flooring options. Polished concrete floors are very easy to maintain, and typically require much less and less expensive care than other types of flooring surfaces.

If the unpolished concrete has some type of topical coating or adhesive present, it is first removed using a prep style abrasive before the process of grinding and polishing the floor may begin.

The grinding and polishing process begins by equipping a grinding and polishing machine with grinding pads or tools that have grits of 30, 70, and 120, which are used successively. These abrasive elements are preferably diamond pads, such as, for example, BevelKut™ diamond discs available from Kut-Rite Manufacturing; they are used successively in those three grits. These abrasive elements are rotated at a relatively slow speed during the grinding steps, e.g., at rotating speeds in the range of about 500 to 800 rpm.

After completion of grinding the floor with the diamond pads, honing steps follow using grinding or polishing pads or tools that have grits of 50, 100, and 200, rotated at, for example, a speed of about 800 rpm. These abrasive elements are preferably resin pads, and are also available from Kut-Rite Manufacturing. After the 200 grit resin pad honing step, dies or stains may be applied to the concrete to provide the desired flooring color. If necessary, a concrete densifier is then applied to the floor.

The grinding and polishing process then continues with polishing steps using a 400 grit resin pad applied to the floor at a relatively higher speed. During the polishing steps, the rotational speeds of the spindles and abrasive elements may be in the range of about 800 to 1,100 rpm. During the polishing step(s), the concrete will start to develop a sheen that will vary with clarity depending on which resin pad grit you are polishing with. For example, the polishing subprocess may be continued through a succession of steps including polishing with resin pads of a type available from Kut-Rite Manufacturing having grits of 800, 1,500 and 3,000, the higher grit numbers generally corresponding to higher spindle rotational speeds. The grit choice of the final resin pad used in the polishing subprocess will depend on the reflection and shine desired of the resulting polished concrete floor. If the polishing process is continued through use of a 3,000 grit polishing pad, for example, the concrete should have a mirror-like finish that almost resembles the look of glass. A burnishing pad may be optionally used at the highest polishing speed after all polishing steps are complete to finish the cleaning process of the concrete floor and give it its ultimate shine. If desired, a topical sealer may be optionally applied to the finished concrete floor.

The concrete floor grinding and polishing process may be dry or wet. It is known to provide a water tank on-board the grinding and polishing machine from which a source of water is provided to the concrete floor. The diamond pads and resin pads may be provided with channels through which the water may be channeled.

The machine may also be provided with a vacuum inlet disposed near the tool pads. Typically, the tool pads are enclosed by a shroud that is in proximity to the floor and surrounds the rotating pads. The vacuum port is connected by a hose to an externally-provided vacuum, which may be nearby or wheeled alongside the grinding and polishing machine.

An example of a prior concrete floor grinding and polishing machine includes a magnetic quick-disconnect tool mounting design by which the diamond and resin tools are mounted to the bottom of the machine. The quick-disconnect system incorporates two locating pins that precisely position each of these abrasive elements on its respective spindle pad, which uses powerful neodymium rare earth screw magnets to hold the tools in place thereon. This arrangement provides a tool system that facilitates quick and precise placing of the tools on the spindle pads for smooth running and holding power that prevents the tools from becoming disengaged with the spindle during operation and facilitates fast removal and replacement of the pads. A known tool pad change procedure includes the following steps: with the motor off, lifting the front end of the machine to distance the tool from the floor, and holding it in a lifted position to gain access to the spindles and the tool pads that are connected thereto; locating a disconnect tab on the magnetic tool holder plate affixed to each spindle; using a screw driver, disconnecting a metal hook from the disconnect tab, and disconnecting a loop puck attachment or metal bond plate from each magnetic tool plate and removing the tool; and positioning a replacement tool (e.g., a diamond or resin pad of the next grit to be used) on each tool plate by lining up two holding pins in the tool plate with corresponding holes in the tool, and reconnecting the loop puck attachment or metal bond plate to the magnetic tool plate, and reconnecting the metal hook to the disconnect tab.

According to one prior machine, a serpentine belt drive is provided by which the single electric motor is in driving engagement with three spindles which rotate about their respective axes in a common direction (i.e., either clockwise or counterclockwise). The serpentine belt may provide up to about 70% contact with the circumference of the pulley driven by the electric motor, and more than 50% contact with the circumference of each of the spindle pulleys rotatably fixed to their respective spindles. Typically the electric motor is of a heavy, cast iron casing type that provides a substantial amount of downward force on the floor, the machine typically weighing as much as 350 to 400 lbs.

The motor may be a single or three-phase electric motor typically having a power rating between five and seven and one half horsepower. The motor is preferably reversible, and it is desirable to periodically operate the motor, and thus rotate the grinding or polishing pads attached to the spindle pads, in opposite directions to open up their abrasive surfaces, dislodging debris that may be captured within their abrading surfaces. This prevents them from becoming clogged or glazed, and thereby extends their life. The motor may also be of variable speed, with slower speeds preferred for grinding operations and higher speeds preferred for polishing operations. The rotating motion of the spindles is performed at a slower speed to perform the earlier steps of the process associated with grinding and honing the concrete floor, whereas the planetary motion of preferably faster-rotating spindles about a central axis, e.g., the motor axis, provides a desirable consistency during the steps associated with polishing.

An example of a prior concrete floor grinding and polishing machine includes a plurality of spindles, with each spindle rotatable at a first speed about its respective axis of rotation. Typically, the spindle positions are held fixed relative to the machine during grinding operations. The spindles may, however, be rotatably attached to and part of a bowl assembly that is itself rotatable about a central axis coincident with the motor axis. The spindles are distributed about a central axis, and also revolve thereabout as satellites, to provide a consistent polishing pattern that is not unlike that which may be created by the Spirograph drawing toy famously marketed in the United States by Hasbro, Inc. and/or Kenner, Inc. The planetary motion of the spindles at a second speed about the bowl central axis may be driven by the electric motor, or it may be passive, with the planetary motion being indirectly driven by the frictional engagement between the rotating abrasive tools and the floor.

A control panel on typical grinding and polishing machines includes an emergency stop button, an on/start button, and a potentiometer by which the rotation speed of the spindles may be changed. Additional controls may include an alarm light, a tachometer, an alarm reset button, and a reverse/forward switch by which the motor direction may be changed. The machine may include an electronic controller box carrying all necessary power conversion circuits for operating the motor. Thus, it is known to utilize a single machine for both grinding and polishing steps, with each of the grinding steps done at a relatively slower speed with the spindle axes held fixed relative to the machine, and each of the polishing steps done at a relatively higher speed with the spindle axes having planetary motion about the single motor axis. The grinding and polishing steps are therefore necessarily performed sequentially, with each step respectively requiring the operator's time.

Although some prior machines are quite effective, it is generally desirable to reduce the time, and thus the labor cost, involved in the grinding and polishing process, and to have capabilities in a single machine that accommodate process variations which can save time and provide process flexibility, and eases its transportation, maintenance, and the abrasive tool replacement that typically occurs multiple times during the grinding and polishing process.

SUMMARY OF THE INVENTION

The present invention provides a floor grinding and polishing machine including a base and a handle. The base includes a shroud, and first and second spindle carriers rotatably coupled to the shroud and having first and second axes of rotation relative to the shroud, respectively. The first and second spindle carrier axes of rotation are spaced from each other in an alignment direction relative to the base. The base also includes first and second pluralities of rotatable spindles, each having an axis of rotation and capable of drivably supporting a floor-engaging abrasive tool. The first plurality of spindles is carried by the first spindle carrier and is distributed about the first spindle carrier axis of rotation; the second plurality of spindles is carried by the second spindle carrier and is distributed about the second spindle carrier axis of rotation. First and second motors are connected to the shroud and are drivingly engaged with the first and second pluralities of spindles, respectively, whereby the spindles of each of the first and second plurality of spindles are rotatably driven about their respective axes of rotation by their respective motor. The floor-engaging handle is coupled to the base and provides an interface between the machine and an operator in control of the machine. The handle defines a direction of operative movement along which the machine may linearly travel relative to the floor. The base has different first and second selective positions relative to the handle in which the alignment direction and the direction of operative movement are at substantially different angular positions relative to each other.

The present invention also provides a floor grinding and polishing machine having a direction of operative movement and including a base and a handle. The base includes a shroud defining a space and having a rim that defines an opening to the space. A motor is mounted to the shroud and a plurality of rotatable spindles is operatively engaged with the motor. Each spindle has an axis of rotation that extends through the shroud opening and is capable of drivably supporting a floor-engaging abrasive tool. The spindles are rotatably coupled to the shroud and are disposed in the space. The machine has an operating configuration in which the spindle axes of rotation extend substantially vertically towards the floor and the space is substantially enclosed, and a nonoperating configuration in which the spindle axes of rotation extend substantially non-vertically and the space is substantially nonenclosed, whereby access to the space is provided through the opening. The floor-engaging handle, by which an operator may controllably engage the machine, is pivotably coupled to the base about a tilt axis and has first and second relative positions about the tilt axis in which the machine is in the operating and nonoperating configurations, respectively. In certain embodiments the machine is supported for rolling transport in the nonoperating configuration.

The present invention additionally provides a floor grinding and polishing machine including a base and a handle pivotably coupled to the base. The base includes a shroud, and first and second spindle carriers rotatably coupled to the shroud, the spindles having first and second axes of rotation relative to the shroud, respectively, the axes of rotation spaced along an alignment direction relative to the base. The spindle carriers each include a gear concentric about its respective axis of rotation. A plurality of spindles is rotatably attached to each spindle carrier, each spindle capable of drivingly supporting a floor-engaging abrasive tool. Each spindle carrier has selective permitted and prevented rotational movement relative to the shroud, with the plurality of spindles having planetary movement about the axis of rotation during rotational movement. The gears of the first and second spindle carriers are selectively rotatably coupled together. Rotations of the first and second spindle carriers about their respective axes of rotation are interdependent when the spindle carrier gears are rotatably coupled and independent when the spindle gears are not rotatably coupled. The handle defines a direction of operative movement of the machine in which the machine has linear travel relative to the floor, and the handle and base have relative angular movement about a pivot axis between angularly spaced positions in which the alignment direction and the direction of operative movement are substantially perpendicular and substantially parallel.

Accordingly, the present invention provides an advancement in the art of floor grinding and polishing that provides increased flexibility in performing the floor grinding and polishing process, reduces time in performing the process, eases transport of the machine, and facilitates movement of the machine through narrow doorways, and quicker and easier replacement of the abrasive tools or the drive belt.

BRIEF DESCRIPTION OF THE DRAWINGS

Other advantages of the present invention will be readily appreciated, as the same becomes better understood by reference to the following detailed description when considered in connection with the accompanying drawings, wherein.

Figure 1:
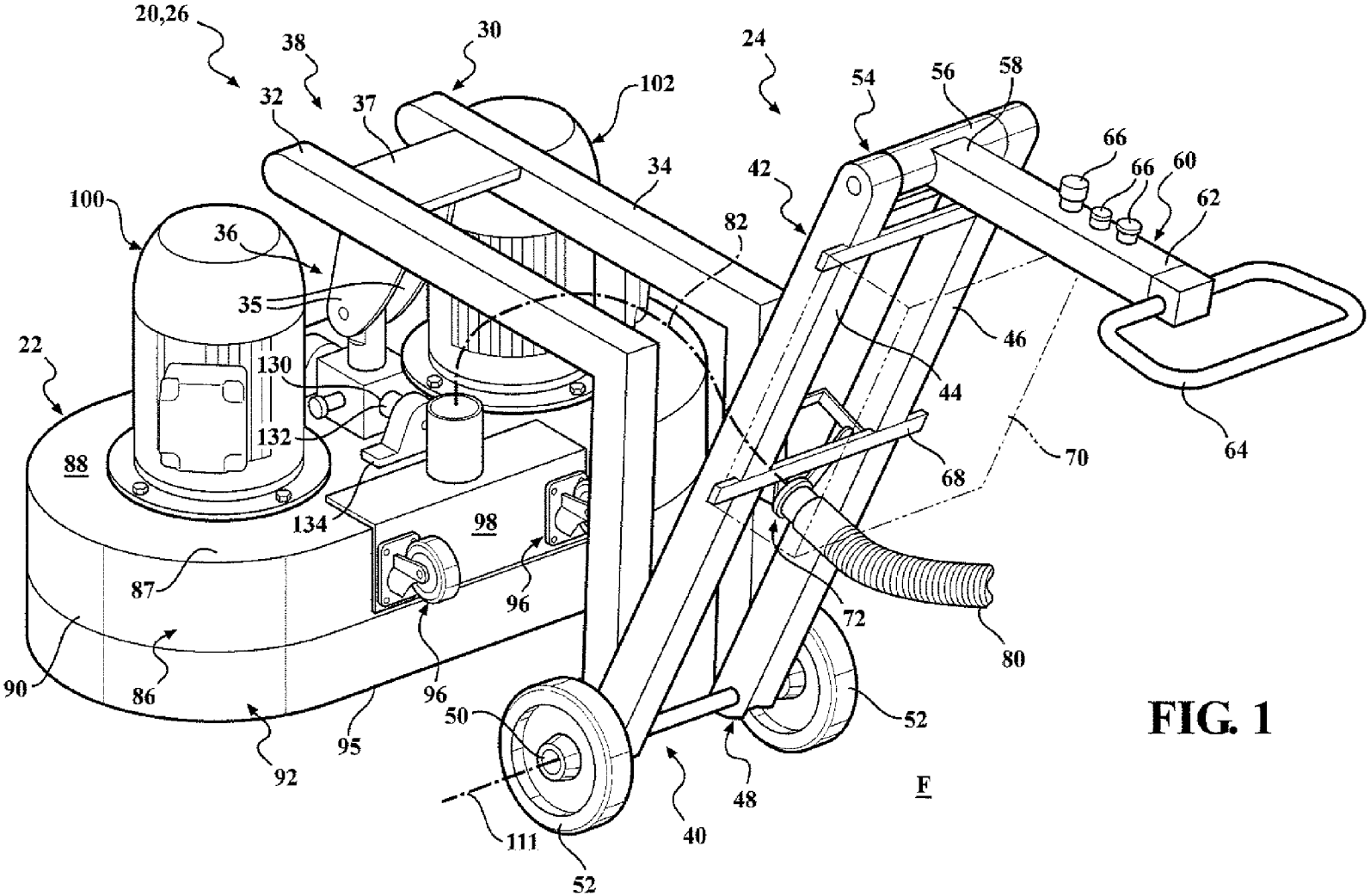
FIG. 1 is a left-rear perspective view of an embodiment of a floor grinding and polishing machine in its wide configuration, with a module housing shown in phantom lines and a vacuum hose attached.

While the invention is susceptible to various modifications and alternative forms, a specific embodiment thereof is shown by way of example in the drawings and may herein be described in detail. It should be understood, however, that the drawings and detailed description herein are not intended to limit the invention to the particular form disclosed, but on the contrary, the intention is to cover all modifications, equivalents and alternatives falling within the spirit and scope of the present invention as defined by the appended claims.

Moreover, it is to be noted that the Figures are not necessarily drawn to scale or to the same scale. In particular, the scale of some of the elements of the Figures may be exaggerated to emphasize characteristics of the elements. Elements shown in more than one Figure that may be similarly configured have been indicated using the same reference numerals.

DETAILED DESCRIPTION OF EXEMPLARY EMBODIMENT(S)

Figure 2:
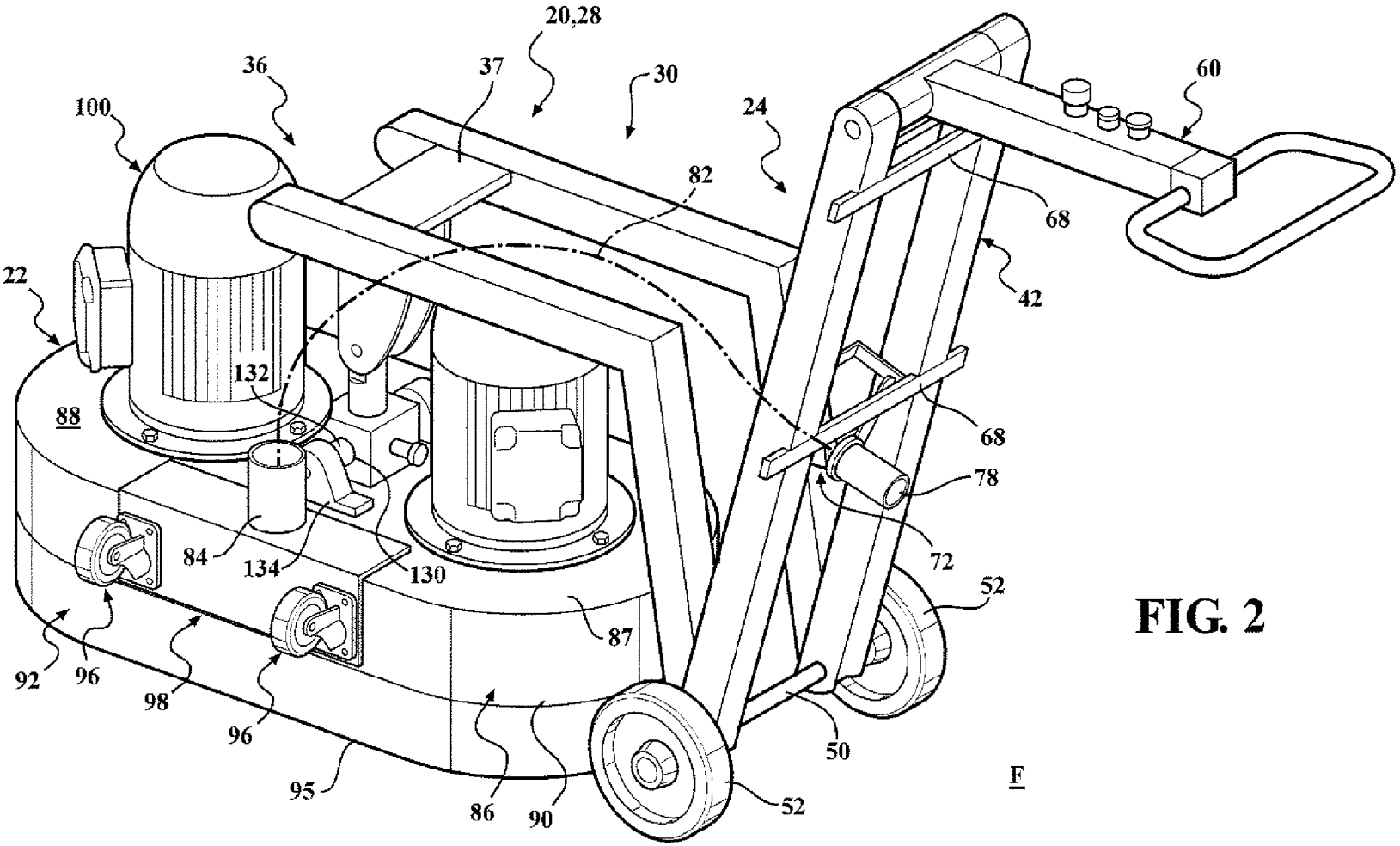
FIG. 2 is a view similar to that of FIG. 1 but showing the machine in a narrow configuration, excluding the module housing and vacuum hose.
Figure 3:
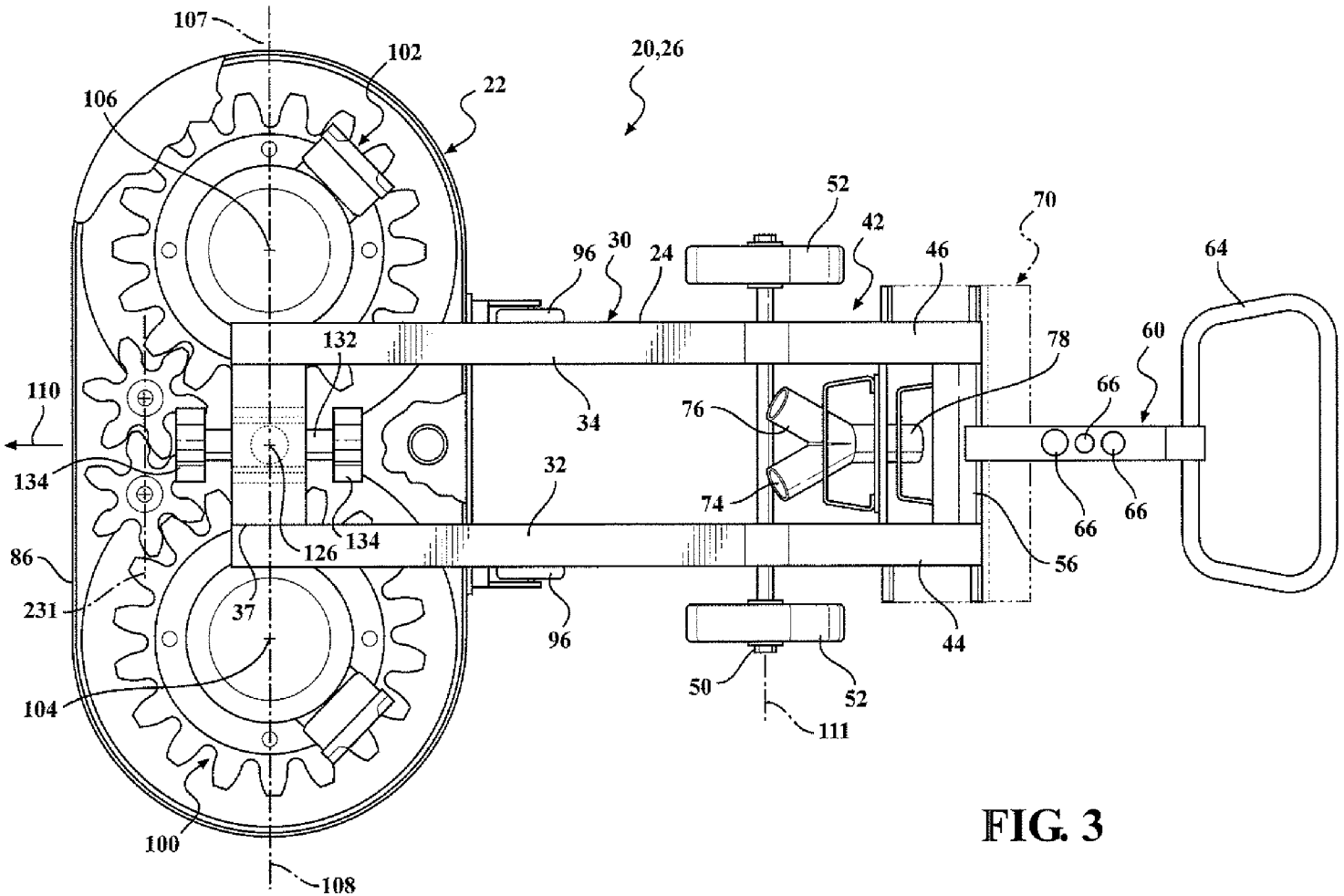
FIG. 3 is a top plan view of the machine configured as in FIG. 1, with its base or head top plate omitted to show the gear mechanism disposed inside the base.
Figure 4:
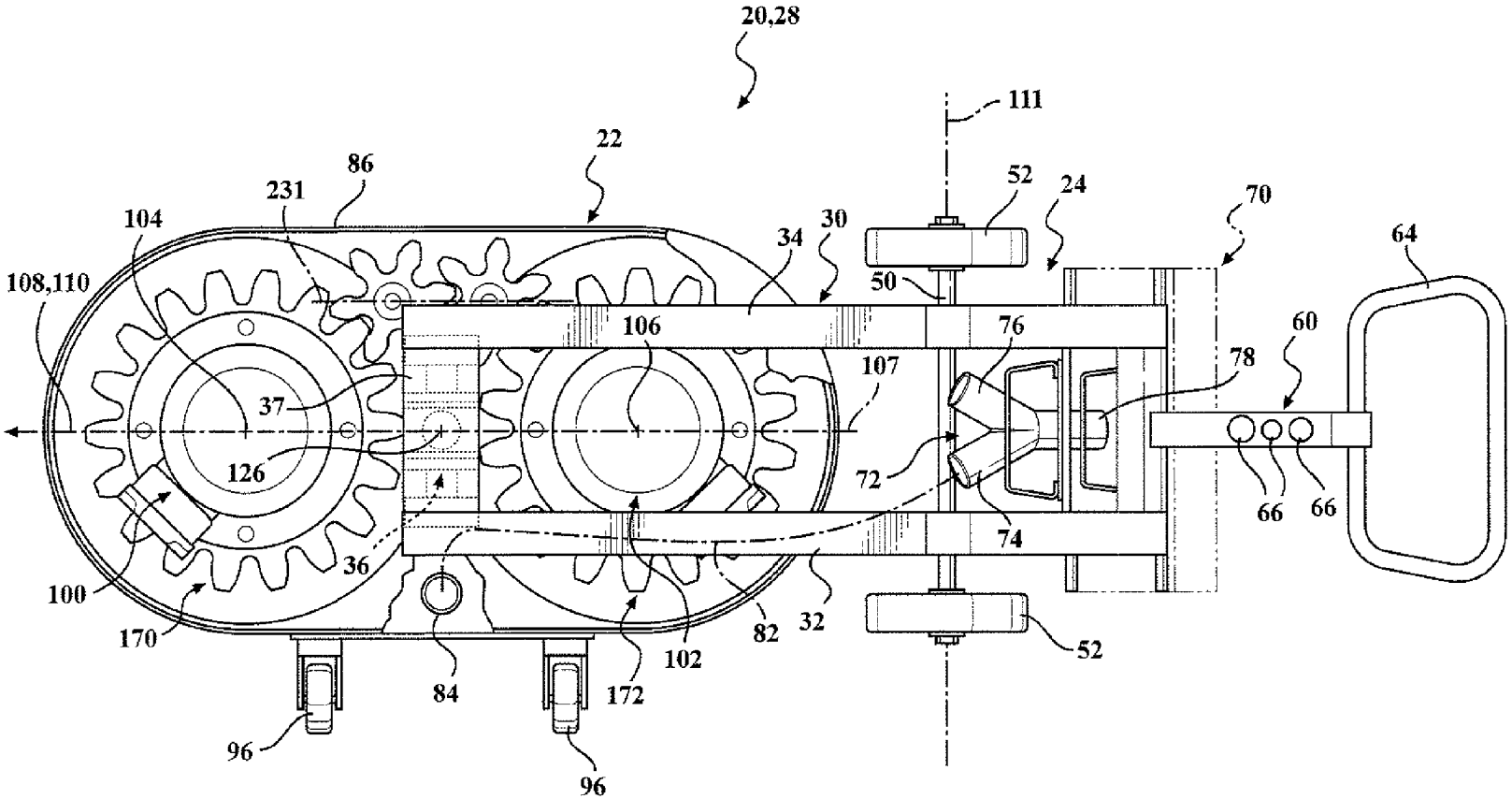
FIG. 4 is a view similar to that of FIG. 3 but showing the machine in a narrow configuration.
Figure 5:
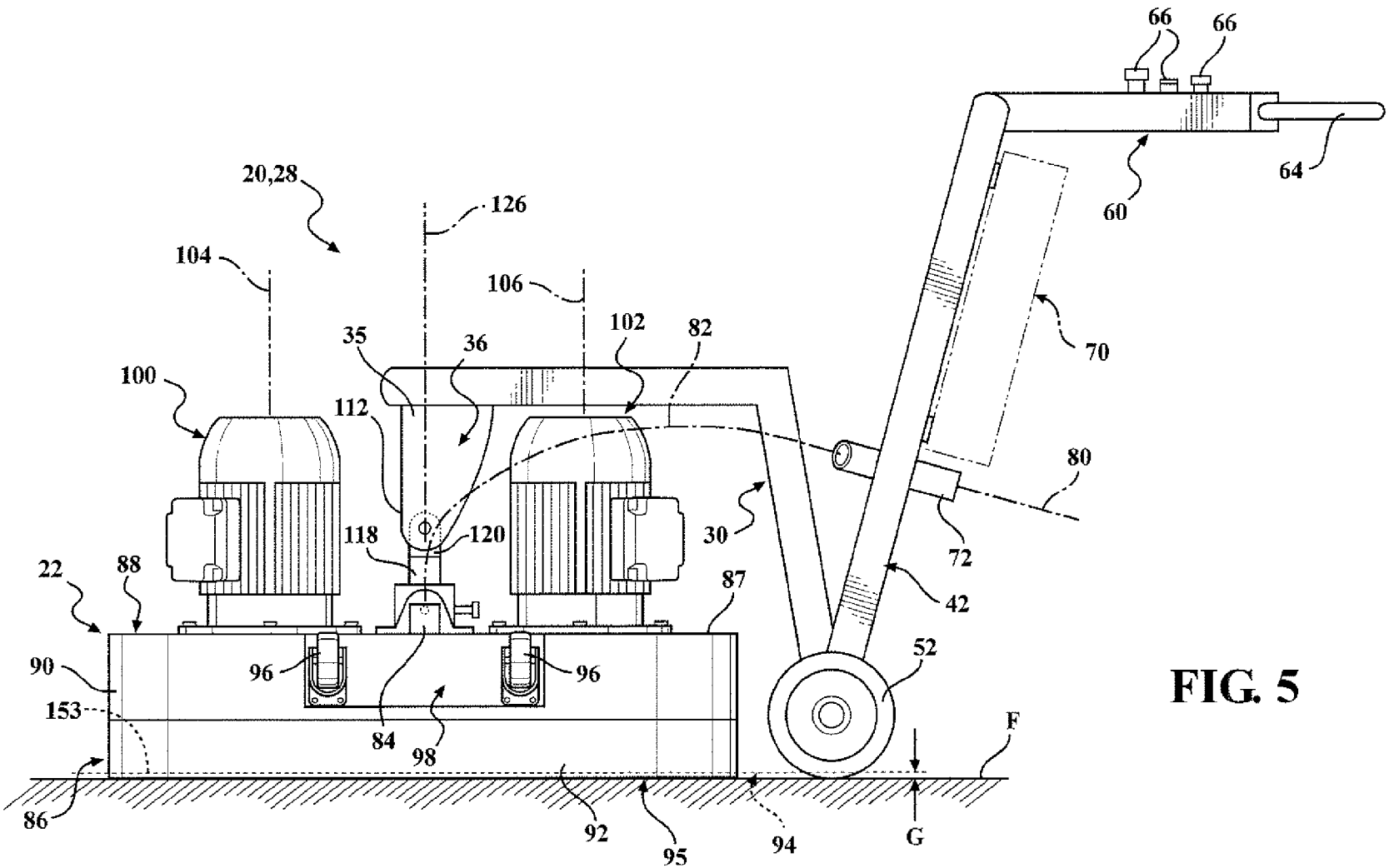
FIG. 5 is a side view of the machine in a narrow configuration.

Referring to the drawings, wherein like numerals indicate like or corresponding parts throughout the several views, there is shown grinding and polishing machine 20 having base or head 22 to which is coupled handle 24. In FIGS. 1-5, machine 20 is shown in a floor-engaging position, and base 22 is shown selectively oriented angularly relative to handle 24 positions separated by 90° to provide machine 20 with wide or double-cut, or narrow or single-cut configurations 26, 28 for floor grinding and polishing operations. Wide configuration 26 is shown in FIGS. 1 and 3; a narrow configuration 28 is shown in FIGS. 2, 4, and 5.

Handle 24 has angled boom 30 including left-hand member 32 and parallel right-hand member 34 which are fixed together. Clevis 36 is affixed to clevis beam 37 extending horizontally between and affixed to boom members 32 and 34 at distal end 38 of boom 30. As shown in FIG. 5, the portion of boom 30 extending from distal end 38 is substantially horizontal. Clevis 36 includes a pair of horizontally-spaced vertically extending parallel plates 35 affixed at their upper ends to clevis beam 37. The proximal end of boom 30 is affixed to frame 42 of handle 24. Frame 42 is generally upstanding, and includes left-hand frame member 44 and right-hand frame member 46 that are spaced and affixed together and substantially parallel with each other. Boom left-hand and right-hand members 32, 34 are angled downwardly towards and affixed to frame left-hand and right-hand members 44, 46, respectively. Frame 42 includes lower end 48 through which extends horizontal axle 50. Attached to the opposite ends of axle 50 are wheels 52 that are in rolling contact with substantially planar, horizontal floor F. Relative to floor F, wheels 52 support handle 24, and also support base 22 when machine 20 is being repositioned or transported, with handle 24 being tipped back on wheels 52.

Upper end 54 of frame 42 is provided with horizontally extending cross-beam 56 that connects left-hand and right-hand frame members 44, 46. Distal end 58 of handle arm 60 is secured to cross-beam 56 and extends rearwardly to its proximal end 62, at which arm 60 is provided with grip 64 by which an operator (not shown) engages machine 20. The various components of frame 24 are rigid and may be formed of heavy gauge steel plate or box beams, and may be attached to each other by means of welding at their fixed joints.

Arm 60 is provided with various electric controls 66 by which the operator may control operation of machine 20. Brackets 68 extend between left-hand and right-hand frame members 44, 46. Attached to machine 20 through brackets 68 is module 70 which is representative of, for example, control electronics for operation of machine 20 and/or a water tank from which water may be provided to floor F via a supply hose (not shown) if a grinding and polishing process is to be a wet process. Alternatively, water may be supplied from externally of machine 20, and/or to floor F externally of machine 20.

Y-shaped manifold 72 having left-hand inlet 74 and right-hand inlet 76 is attached to frame 42, and in the depicted embodiment, right-hand inlet 76 is capped or blocked off, and on-board vacuum hose 82 (shown schematically) is attached to left-hand inlet 74. Manifold 72 also includes outlet 78 located below module 70 and to which is attached one end of off-board vacuum hose 80, the opposite end of which is connected to a vacuum (not shown). As mentioned above, the vacuum may be located nearby or wheeled alongside machine 20 during performance of the grinding and polishing process. Alternatively, the vacuum may be directly connected via a hose to nozzle outlet 84. In the depicted example, on-board hose 82 extends from left-hand manifold inlet 74 to outlet 84 of a vacuum nozzle fixed to base 22, the nozzle inlet located within the space defined by shroud 86 and positioned proximate to the abrasive tools and floor F during grinding and polishing operations.

Figure 11:
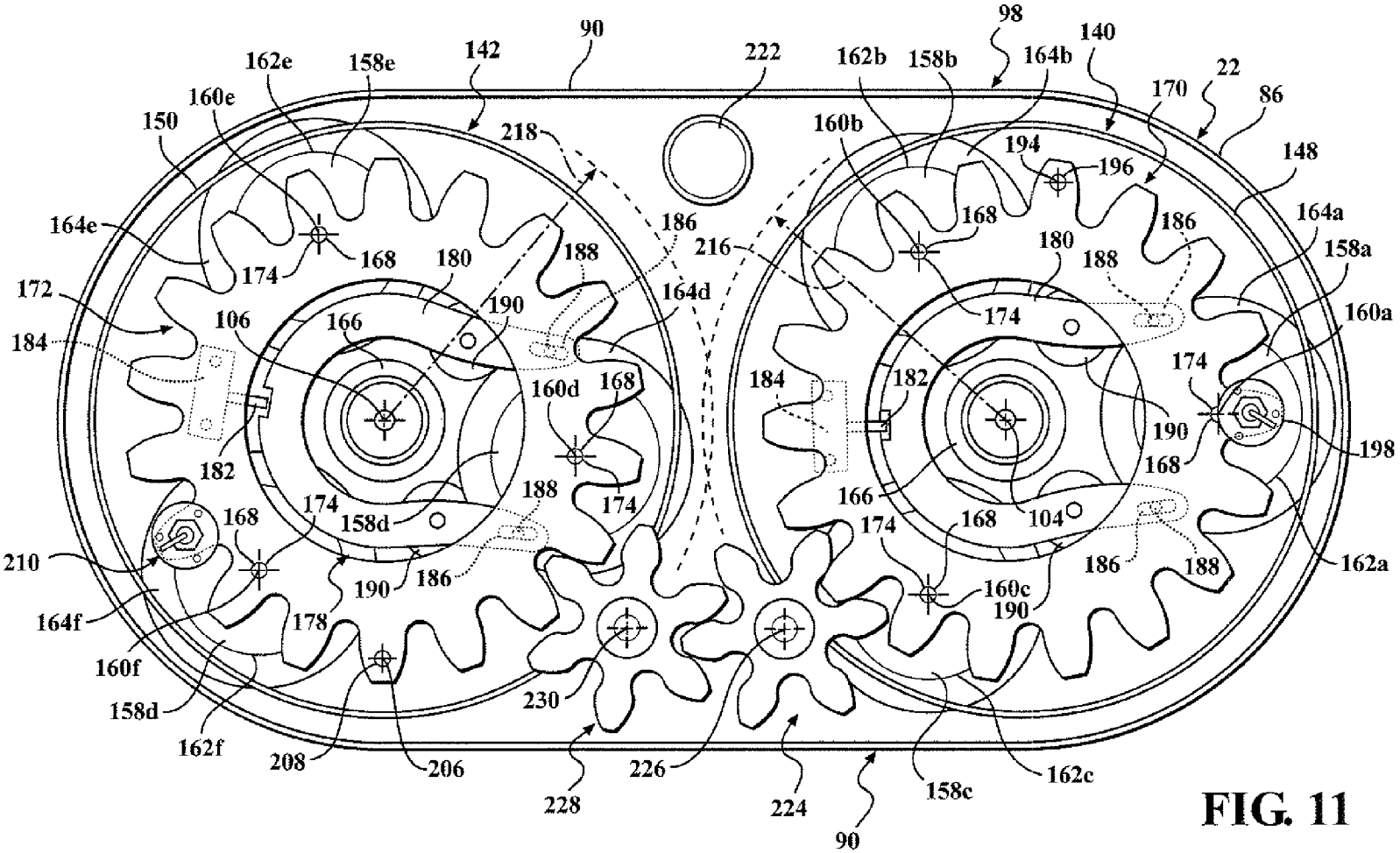
FIG. 11 is a partially sectioned, top plan view of the machine base with the top plate of is shroud omitted.
Figure 12:
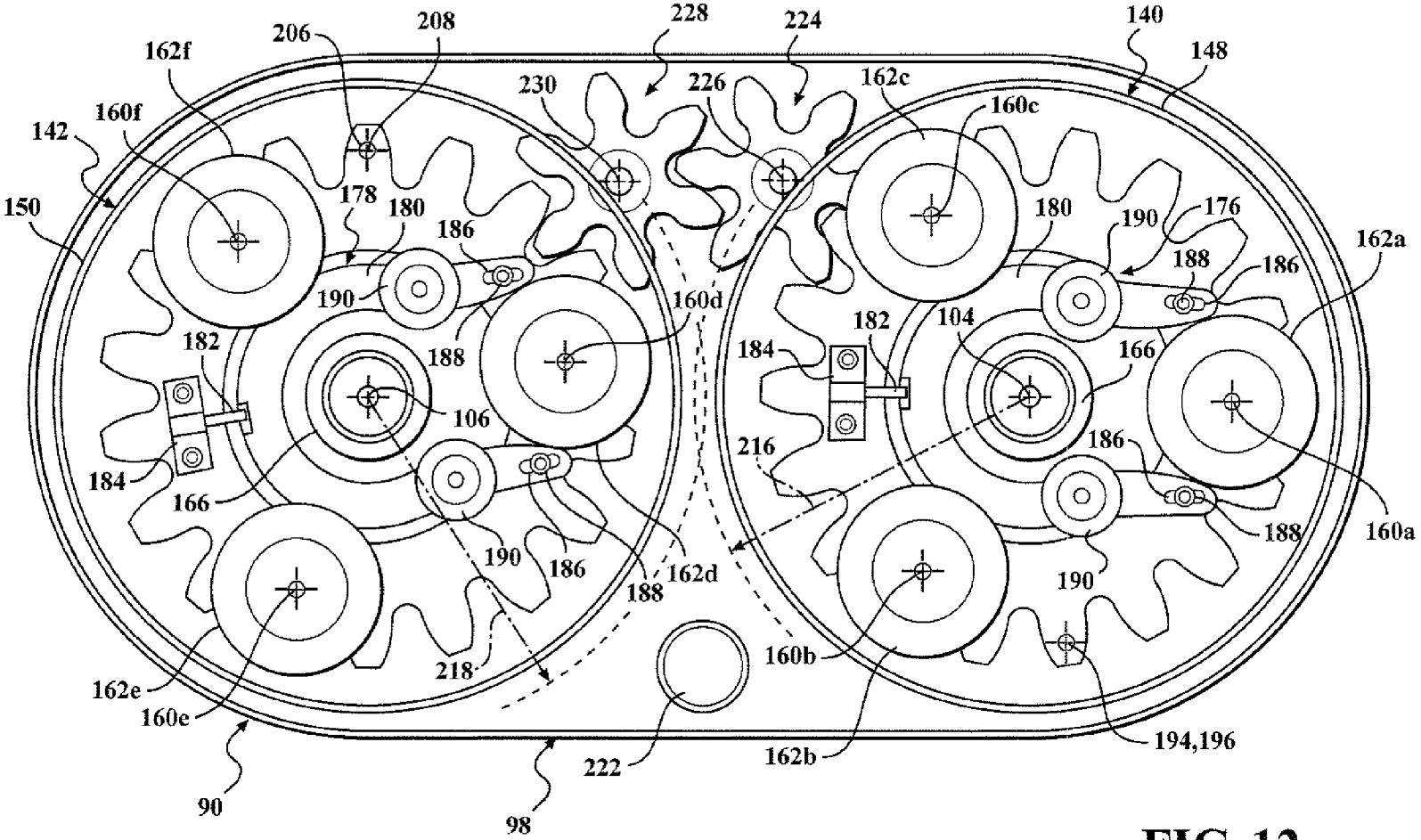
FIG. 12 is a partially sectioned, bottom plan view of the oblong machine base, rotated relative to the page 180° about its length, with the turntable plates and spindle pads of its bowl assemblies omitted.
Figure 13:
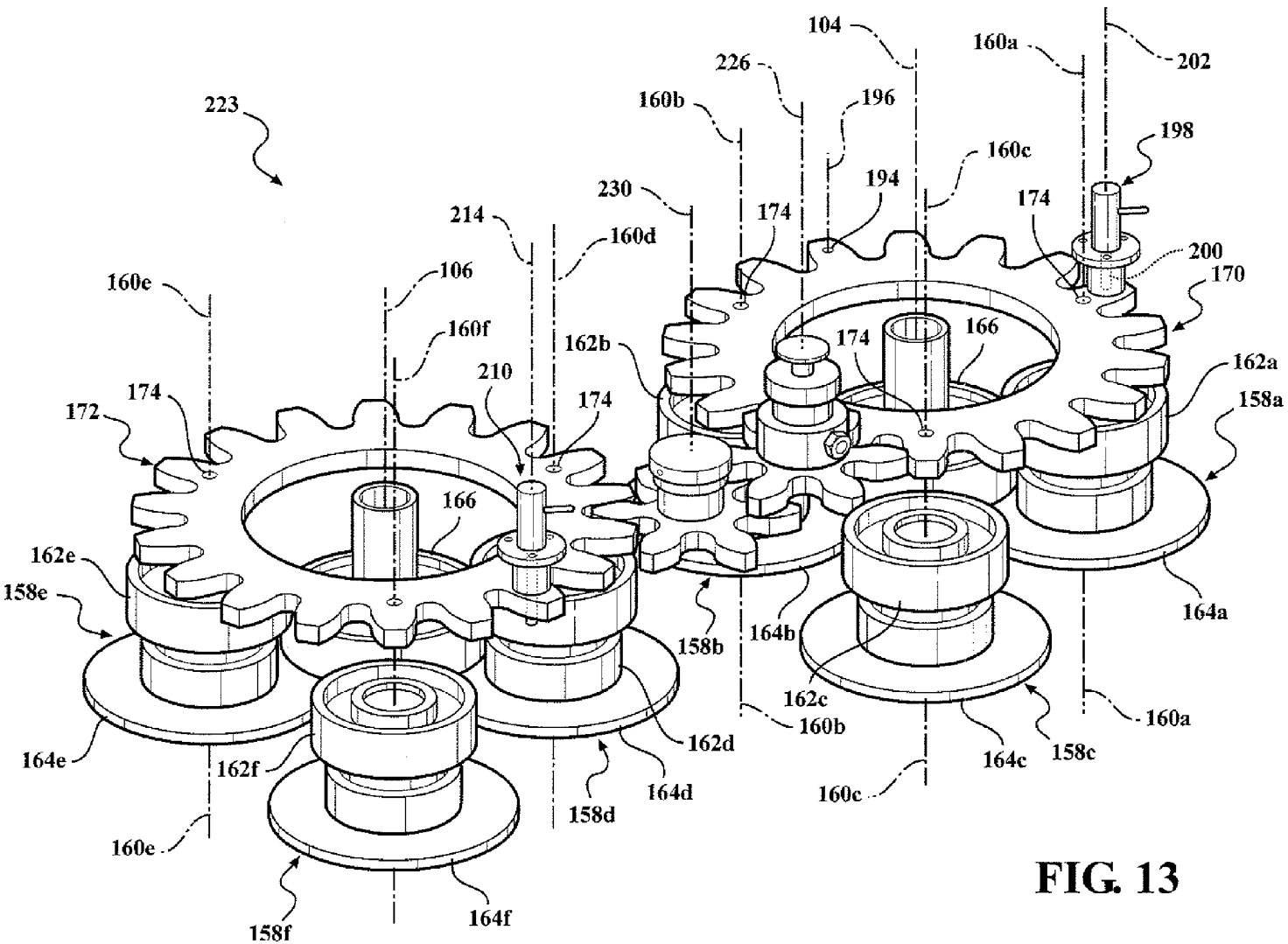
FIG. 13 is an upper perspective view of the gear mechanism of the machine, showing its turntable gears disengaged from each other.
Figure 14:
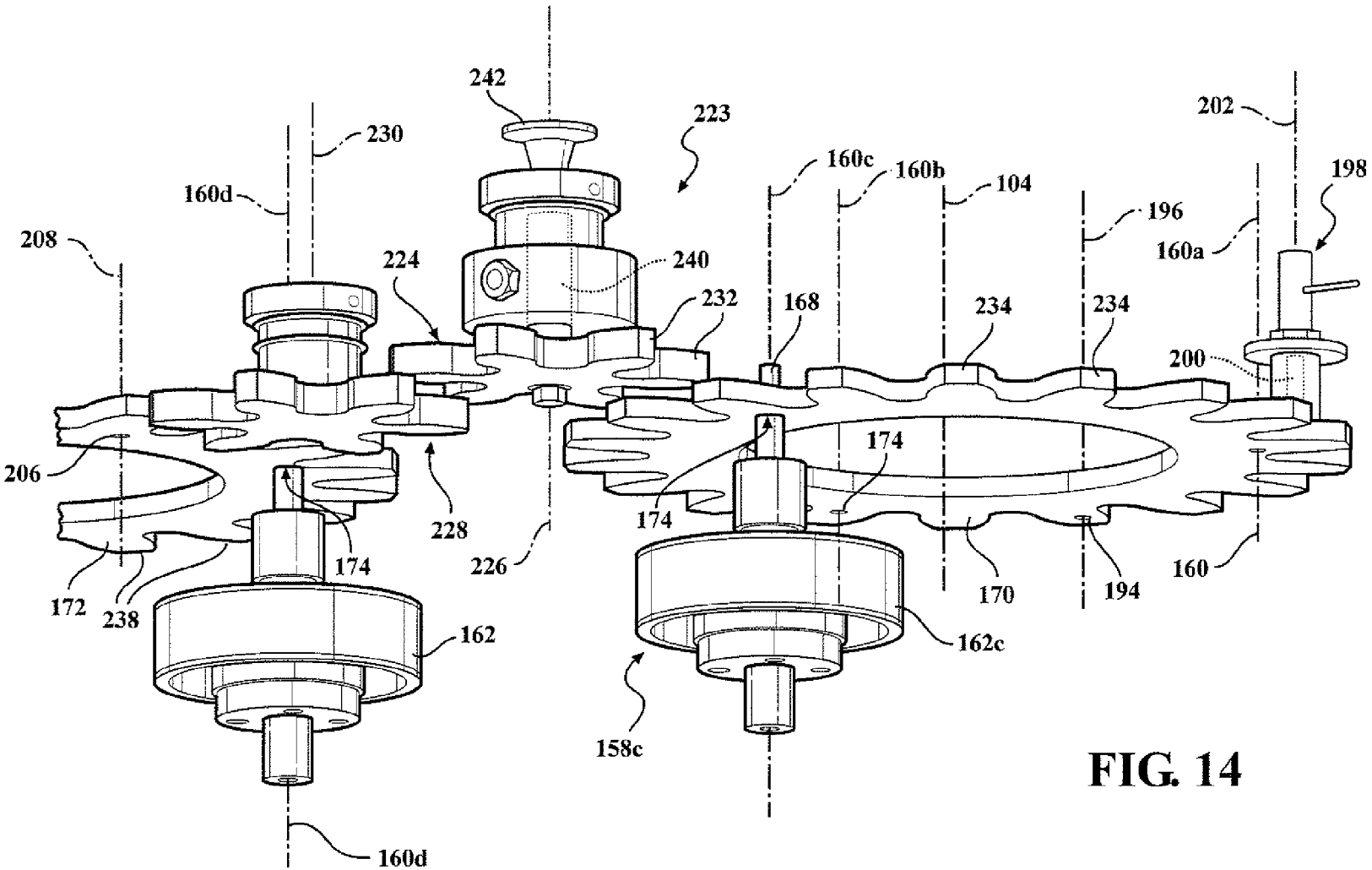
FIG. 14 is an enlarged, fragmented, partial, lower perspective view of the gear mechanism shown in FIG. 13.
Figure 15:
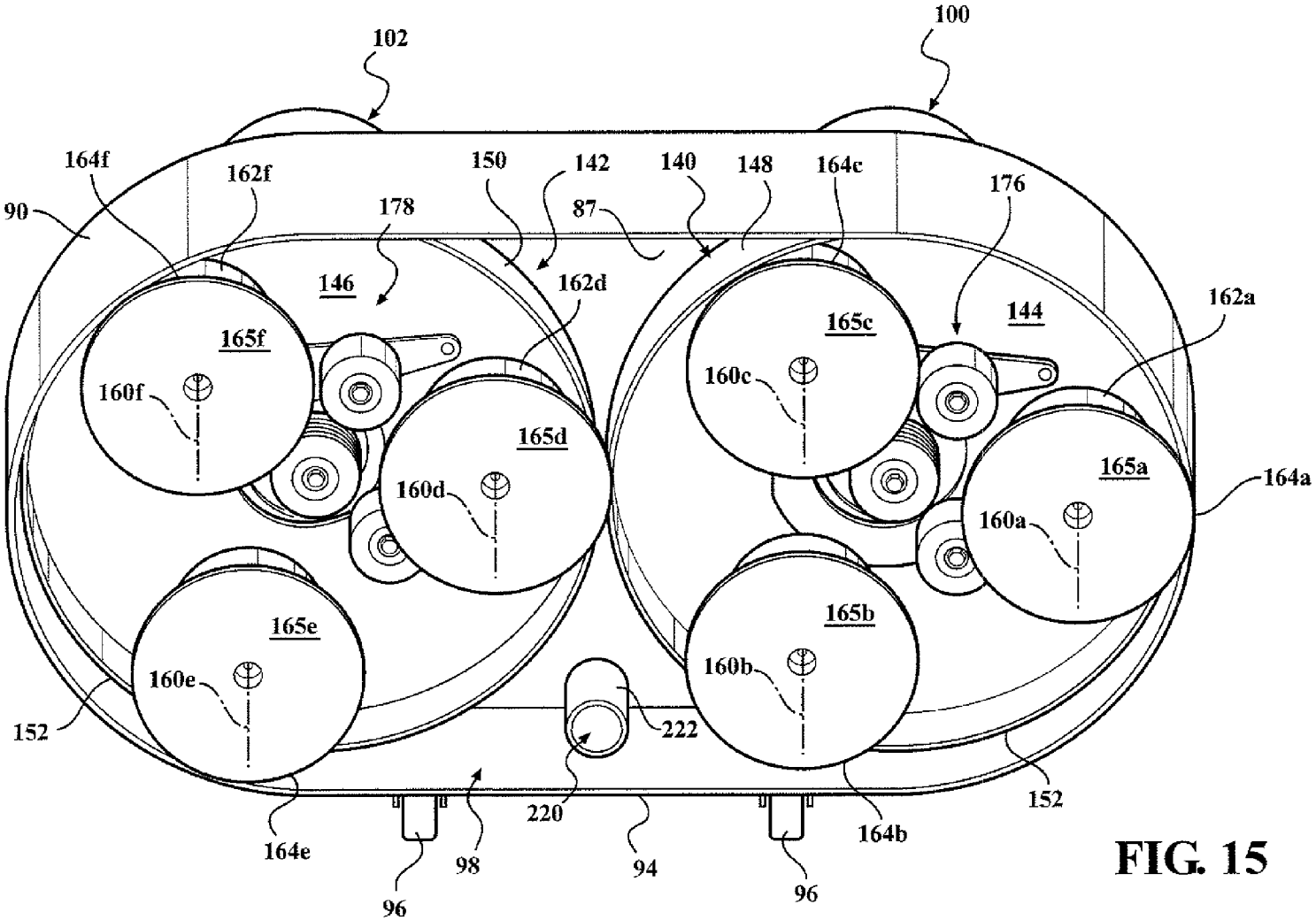
FIG. 15 is a lower perspective view of the machine base, the bowl assembly bottom covers and drive belts omitted.

FIGS. 11, 12, and 15 show inlet 220 of vacuum nozzle 222, which is affixed to plate 87 of shroud 86. Inlet 220 is open to a region of the space enclosed by shroud 86 that is adjacent to elongate vertical wall portion 98 and close to floor F, for collection of ground-away particles from floor F and abrasive tools 300 generated during grinding and polishing processes.

Shroud 86 includes oblong upper plate 87 defining planar, oval-shaped, horizontal upper surface 88 of base 22, from which vacuum nozzle outlet 84 vertically extends, and vertical wall 90 that extends continuously about and depends from the perimeter of horizontal plate 87 toward floor F. Vertical wall 90 itself may extend almost the entire distance from plate 87 to floor F, or it may, as shown, terminate at some distance above the floor and be provided with removable surrounding skirt 92 of a pliable, rubberized material attached and conforming to the perimeter of vertical wall 90, and that extends to floor F. Skirt 92 may be a broad, flat, elongate strip of rubber material attached to the outside surface of wall 90 with, for example, hook and loop fasteners (not shown). Skirt 92 helps prevent damage to nearby structures against which machine 20 may bump as it is operated near them, and retains within shroud 86 debris resulting from the grinding and polishing process. Vertical wall 90 defines lower edge or rim 94 of shroud 86 that is closely spaced by gap distance G (FIG. 7) of preferably about an inch or less from floor F. Skirt 92 defines lower edge or rim 95 that slidably engages floor F, and partially seals gap G to facilitate maintenance of a partial vacuum inside shroud 86 when machine 20 is connected to a vacuum, but permits adequate airflow into the shroud to allow debris to be drawn into its vacuum nozzle. Horizontal plate 87 and vertical wall 90 may be formed of heavy gauge plate steel, and rims 94 and 95 substantially match the oval-shaped perimeter of plate 87.

A pair of spaced casters 96 is affixed to an elongate portion 98 of vertical wall 90. In wide configuration 26, portion 98 is rearwardly-facing. In the shown narrow configuration 28, wall portion 98 is leftwardly-facing, although in certain embodiments base 22 may be adaptable to alternatively rotate by +90° from wide configuration 26 relative to handle 24 such that a narrow configuration 28 may be selectively assumed in which portion 98 of vertical wall 90 is rightwardly-facing instead of leftwardly-facing as shown. In such embodiments, this alternative narrow configuration 28 may benefit from on-board hose 82 being connected to right-hand vacuum manifold inlet 76, and left-hand inlet 74 being capped or blocked. The capability of such embodiments of machine 20, to be reconfigured from its wide configuration 26 to alternative narrow configurations 28 through reorientation of base 22 relative to handle 24 through ±90° rotation therebetween, accommodates narrow-cut operation of machine 20 along walls, irrespective of the direction of machine travel relative to the wall, which might otherwise result in interference between the wall and casters 96. With machine 20 in wide configuration 26, it may also be reconfigured so as to bring casters 96 downward and into rolling engagement with floor F for easy transport of the machine, and to support base 22 during abrasive tool removal and replacement, or maintenance such as drive belt adjustment or replacement, as discussed further below.

Affixed to horizontal plate 87 of shroud 86 are left-hand electric motor 100 and right-hand electric motor 102. Motors 100, 102 respectively have longitudinal axes 104 and 106 about which their output shafts respectively rotate. Motors 100, 102 may be identical, and are each reversible and of variable speed. They may, for example, each be 7½ horsepower single or three-phase brushless AC motors manufactured by WEG Electric Corporation. Motors 100, 102 may be controlled by a variable frequency drive available, for example, from Yaskawa America, Inc., the controller drive housed within module 70. The rotational speeds of motors 100, 102 may be independently varied, but their reversible output shaft rotation directions are in opposite directions about axes 104, 106. A reversing switch is included among electrical controls 66 that permits the operator to reverse the respective motor rotation directions together. Preferably, the motors cannot be independently reversed. Motors 100, 102 may have heavy, cast iron housings providing desirably sufficient weight for bearing the abrasive tools against floor F during grinding and polishing operations. Machine 20 may, for example, weigh more than 400 lbs.

Axes 104, 106 are substantially parallel and contained in an imaginary plane 107 that is fixedly perpendicular to shroud surface 88 and along which is defined alignment direction 108 of base 22; parallel axes 104, 106 are spaced along alignment direction 108. In wide configuration 26, alignment direction 108 is substantially perpendicular to direction of operative movement 110. In the narrow configuration(s) 28 of machine 20, alignment direction 108 and direction of operative movement 110 are substantially parallel. Direction of operative movement 110 refers to the axial direction along which machine 20 has forward, straight-line movement, and is substantially perpendicular to longitudinal axis 111 of axle 50; the elongate, horizontally-extending portions of boom 30 generally extend in parallel with direction of operative movement 110. It is to be understood, however, that machine 20 also has operative movement in other directions in which it is guided by the operator. In other words, during grinding and polishing operations, forward, straight-line movement of machine 20 relative to floor F is generally along its defined direction of operative movement 110, with the operator following machine 20. The machine in its floor-engaging position is supported abrasive tools 300 which, during grinding and polishing operations are each rotating, and possibly also revolving about their respective motor axis 104, 106. Although machine 20 tends to generally "float" or "hover" and remain in place on floor F, it is held steady, pushed, pulled, or turned easily by the operator's exerted influence on grip 62.

The horizontally spaced vertical plates 35 of clevis 36 are parallel with the direction of operative movement 110 and are provided, near their lower, terminal ends 112, with horizontally aligned apertures 114. Clevis 36 has stop member 116 fixed between vertical plates 35 that defines downwardly-facing stop surface 117 positioned higher than apertures 114. Base 22 is provided with rotatable shaft 118 that extends substantially perpendicularly relative to surface 88 and is provided with a pair of diametrically-opposing, parallel flat surfaces 120 between which extends horizontal bore 122. Surfaces 120 slidably engage the interfacing planar surfaces of plates 35, and bore 122 is aligned with apertures 114. Lynchpin 124 having axis 125 extends through clevis 36 and shaft 118, disposed in bore 122 and apertures 114.

Figure 8:
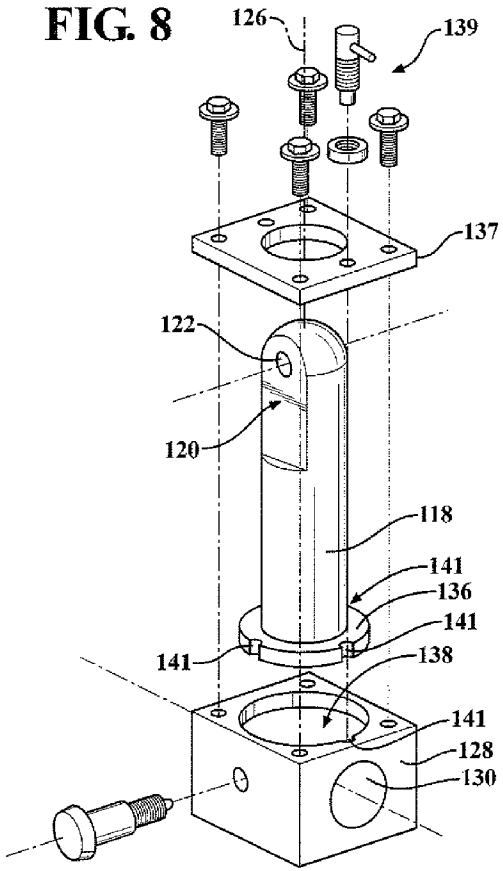
FIG. 8 is an exploded view of the assembly of the slider block and rotatable shaft.

Rotatable shaft 118 has longitudinal axis 126 that is perpendicular to horizontal bore 122, and extends into attached slider block 128. An exploded view of the assembly of the rotatable shaft 118 and slider block 128 is shown in FIG. 8. Axis 126 is substantially normal to shroud planar surface 88.

Shaft 118 has a circular flange 136 and is secured to slider block 128 by collar plate 137 having a circular opening that surrounds the cylindrical body of shaft 118, the underside of plate 137 slidably closing the flange 136.

Flange 136 is received in shallow circular recess 138 provided in the top of slider block 128, and is sandwiched between the underside of plate 137 and the planar bottom surface of recess 138 which is normal to axis 126. Lock mechanism 139 extends through plate 137 and is selectively disposed within a hole defined by a mating pair of semi-circular notches 141 in the peripheries of flange 136 and recess 138. Notches 141 in the periphery of recess 138 are angularly spaced 90° about axis 126. The single notch 141 in flange 136 is aligned with one of the recess notches 141 in a corresponding wide or narrow configuration 26, 28. Lock mechanism 139 is selectively retracted to clear the hole defined by notches 141 and facilitates the relative rotation between shaft 118 and slider block 128 about axis 126. Thus, slider block 128 and shaft 118 are fixed against mutual relative movement along axis 126, but are relatively rotatable about axis 126 between first and second angular positions that are separated by 90° about axis 126. Base 22 and handle 24 are selectively locked against relative rotation about axis 126 in the first and second angular positions.

As discussed above, in some embodiments, the second angular position may be separated by ±90° relative to the first angular position, to facilitate angular movement between wide configuration 26 and one of a pair of alternative narrow configurations 28 in which portion 98 of vertical wall 90 is alternatively leftwardly or rightwardly-facing. The first angular position corresponds to wide configuration 26, and the second angular position(s) correspond to narrow configuration(s) 28. Slider block 128 and shaft 118 are selectively fixed against relative rotation in either the first or a second position, to maintain machine 20 in its selected wide configuration 26 or narrow configuration 28, respectively.

Slider block 128 is provided with bore 130 through which extends cylindrical support shaft 132, the axis of which is substantially parallel with surface 88 and normal to imaginary plane 107. The ends of support shaft 132 are axially fixed and rotatably supported in pillow blocks 134, which are attached to shroud plate 87. The position of slider block 128 along the axis of cylindrical shaft 132 is selectively fixable at variable locations, providing base 22 with different positions relative to handle 24 to allow adjustments to the balance of machine 20 or the evenness of the abrading pattern. In wide configuration 26, slider block 128 may, for example, be selectively located along shaft 132 such that axis 126 is positioned forward of imaginary plane 107, and closer to the forward-most one of the pair of pillow blocks 134, as shown in FIG. 3. In narrow configuration(s) 28, axis 126 may be selectively positioned substantially centrally along shaft 132 between pillow blocks 134 and in plane 107, as shown in FIG. 4.

Figure 6:
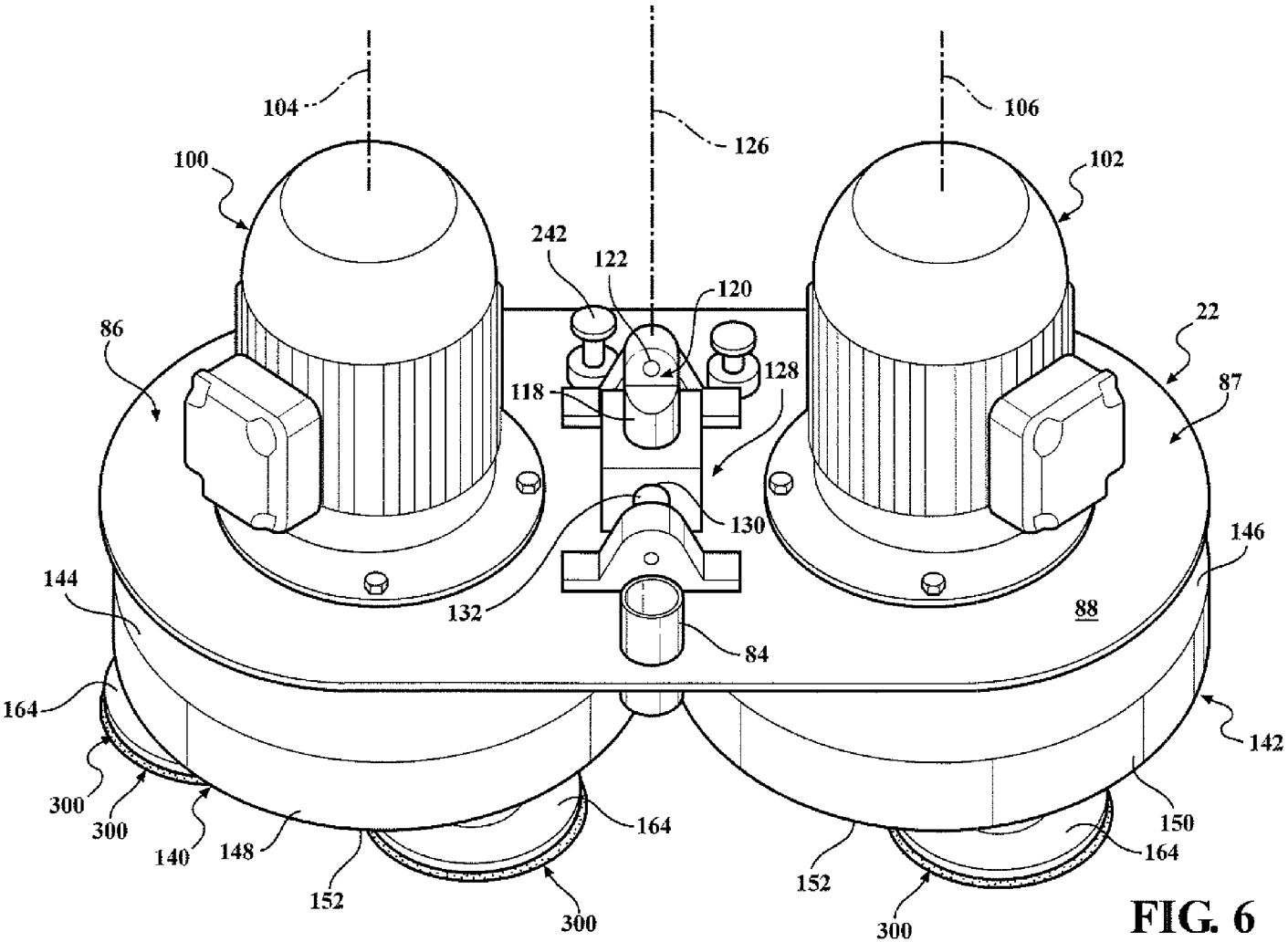
FIG. 6 is a perspective view of the base or head of the machine shown in FIGS. 1-5, with a portion of the vertical wall of its oblong shroud removed, and including abrasive tools attached to its spindle pads.
Figure 7:
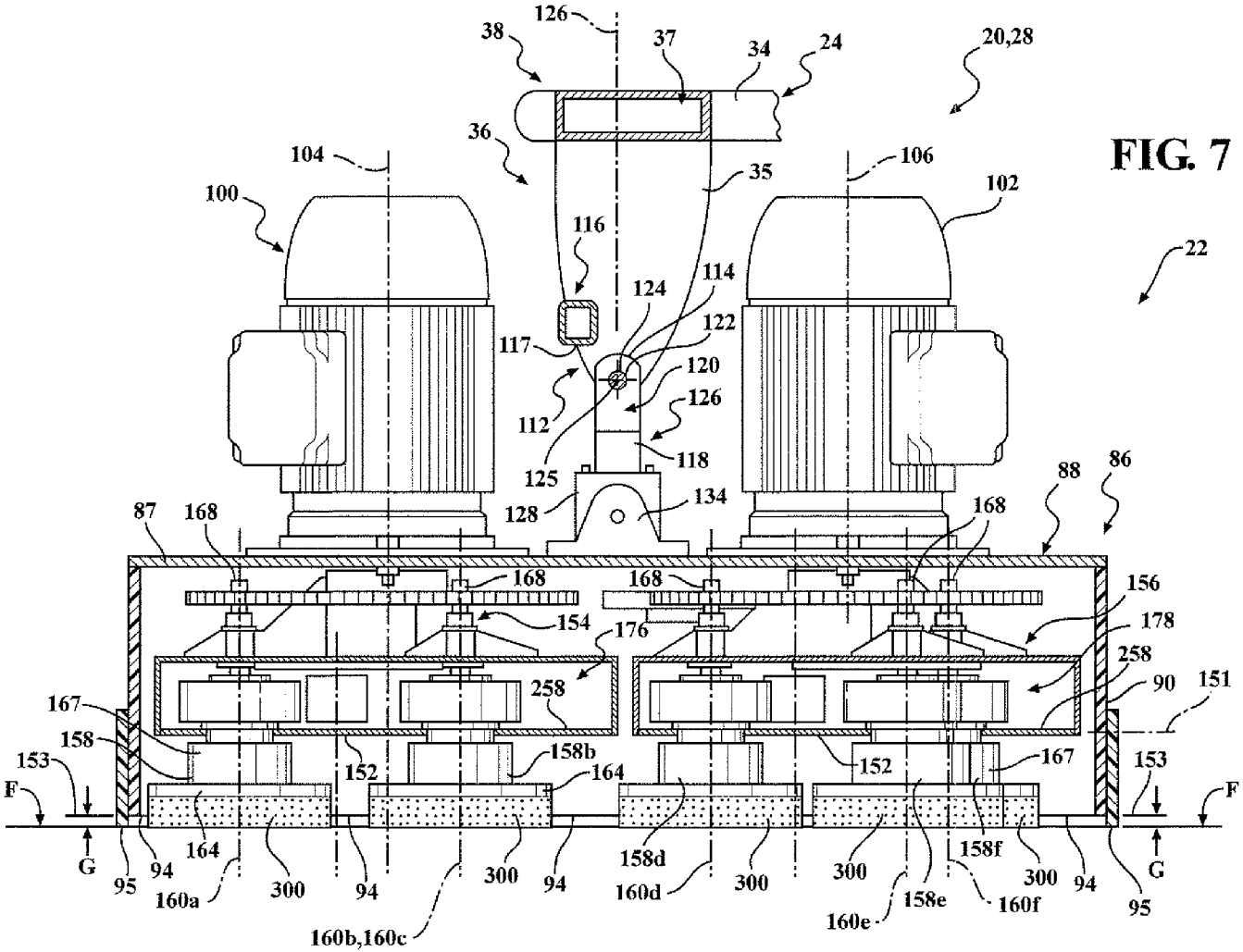
FIG. 7 is an enlarged, fragmented, and partially sectioned view of the machine as shown in FIG. 5, with a portions of the vertical wall of its oblong shroud and bowl assemblies omitted, and including abrasive tools attached to its spindle pads.

Referring to FIGS. 6 and 7, base 22 is provided with left-hand bowl assembly 140 and right-hand bowl assembly 142 that are disposed within, and are selectively rotatable relative to, shroud 86. Left-hand bowl assembly 140 and right-hand bowl assembly 142 include substantially planar and circular turntable plates 144 and 146, respectively, from which respectively depend cylindrical walls 148, 150, each of which defines its circular bottom edge or rim 152. Edges 152 both lie in imaginary plane 151 that is substantially parallel with imaginary plane 153 that contains oval shroud bottom edge or rim 94. Turntable plates 144, 146 and their respective cylindrical walls 148, 150 may be formed of steel plate, and welded together.

Left-hand bowl assembly 140 and right-hand bowl assembly 142 include bearing structures 154 and 156, respectively, that include castings or weldments affixed to the upper side of turntable plates 144, 146, with bearing structures 154, 156 disposed between turntable plates 144, 146 and planar plate 87 of shroud 86. Bowl assemblies 140, 142 are centered about motor axes 104, 106, respectively, and each is rotatably mounted via its respective bearing structure 154, 156 to the output shaft of its motor 100, 102. Bowl assemblies 140, 142 are each rotatably attached in a known manner that is employed in prior floor grinding and polishing machines that have a passively rotatable bowl assembly to which a plurality of belt-driven, rotatable spindles is distributed about a drive pulley fixed to the motor output shaft. Motors 100, 102 and their respective bowl assemblies 140, 142 are fixed against relative movement along their respective axes 104, 106, with bowl assemblies 140, 142 capable of freely rotating relative to the motor housings fixed to shroud 86 and their output shafts which extend along axes 104, 106.

Each bowl assembly 140, 142 includes three rotatable spindles or spindle assemblies 158; spindle assemblies 158*a-c* are distributed at 120° increments about motor axis 104, and spindle assemblies 158*d-f* are similarly distributed about motor axis 106. Each of spindle assemblies 158*a-f* is rotatable about its respective axis of rotation 160*a-f*, and as discussed above, while spindles 158*a-c* rotate in one direction about their axes 160*a-c*, spindles 158*d-f* rotate in the opposite direction about their axes 160*d-f*. Each of spindle assemblies 158 includes cylindrical pulley 162 and affixed spindle pad 164 concentric with its axis of rotation 160. Attached to first and second motors 100, 102 are drive pulleys 166 that are concentric about the respective axis of rotation 104, 106, and are rotatably fixed to the respective motor output shaft (not shown). Each pulley 166 is surrounded by the respective distributed plurality of spindle assemblies 158*a-c* or 158*d-f* of its bowl assembly 140 or 142.

Each of spindle pads 164 defines substantially planar and circular bottom surface 165 to which an abrasive tool 300, which may be a grinding pad or polishing pad as described above, is removably attached. The manner in which tools 300 are attached to spindle pads 164 is known, and may be such as described above despite spindle pad surfaces 165 being depicted in the drawings as substantially featureless. The co-planar surfaces 165 of spindle pads 164 are substantially parallel with plane 153 containing shroud rim 94, but are spaced therefrom by a distance that is preferably less than the thickness of the abrasive tools 300. Rim 94 defined by shroud vertical wall 90 is in close proximity to floor F, with vertical clearance gap G being defined between rim 94 and floor F. Therefore, base 22 is supported on installed tools 300, and rim 94 does not contact floor when tools 300 are installed. As discussed above, skirt 92 extends about and is secured to shroud vertical wall 90, and its bottom edge 95 slidably engages floor F.

Figure 10:
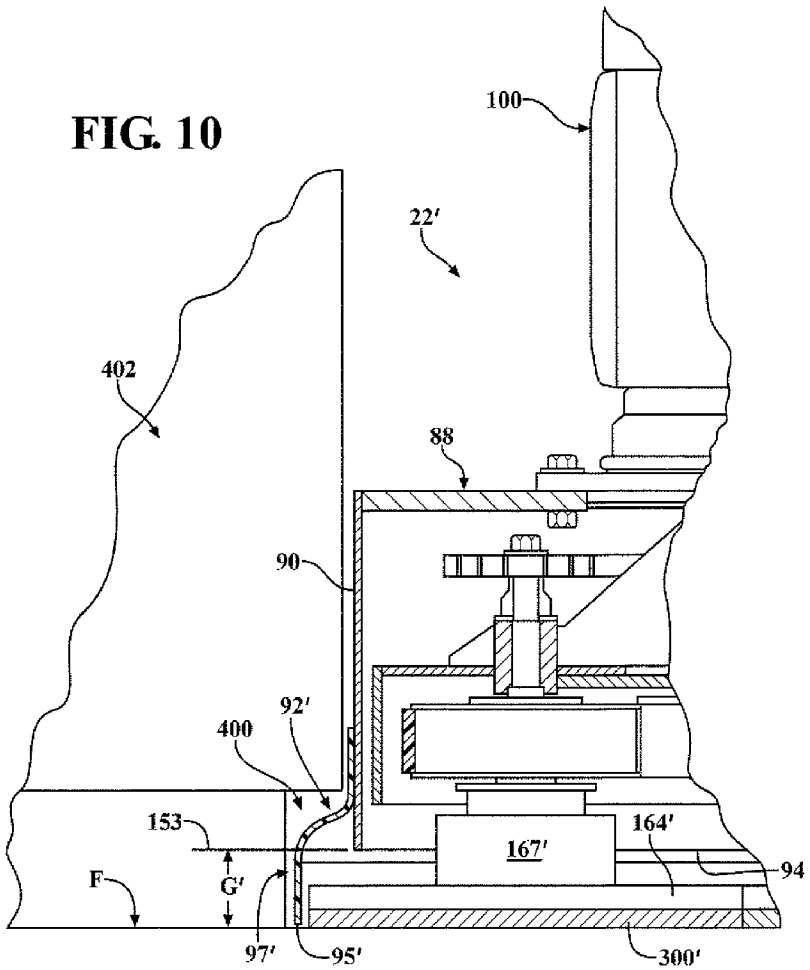
FIG. 10 is a fragmentary, partial view of a machine having the base shown in FIG. 9, partially disposed within the toe-kick space of a structure resting on a floor.
Figure 9:
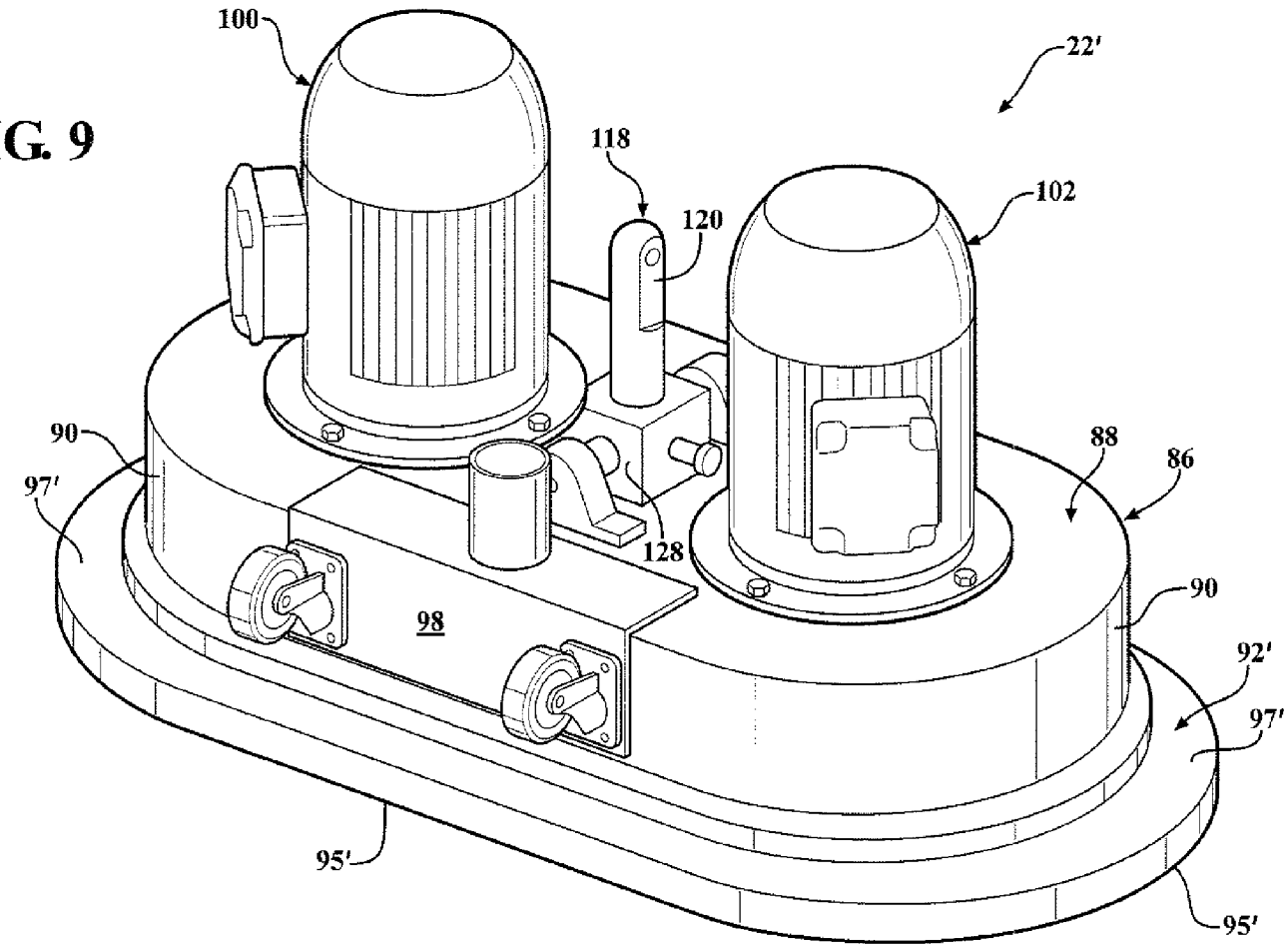
FIG. 9 is an upper, rear perspective view of an alternative head or base configured to provide a relatively larger abrasive pattern.

FIGS. 9 and 10 show an alternative embodiment base or head 22' substantially identical to base 22 but is configured to provide an enlarged abrading pattern. Base 22' is provided with spindle assemblies 158' that are substantially identical to spindle assemblies 158 described above, but have cylindrical portions 167' that are axially longer than cylindrical portions 167 (FIG. 7) and spindle pads 164' that are larger in diameter than spindle pads 164.

The upper planar surfaces of spindle pads 164' are located below plane 153 defined by lower edge 94 of shroud vertical wall 90, and extend beyond its periphery. Spindle pads 164' are substantially larger in diameter, for example, four inches larger in diameter, than the diameter of spindle pads 164, and are outfitted with correspondingly larger diameter abrasive elements 300' of various grits instead of the abrasive elements 300 used with base 22. In place of skirt 92, base 22' is provided with molded rubber skirt 92' that is fitted about and attached to shroud vertical wall 90. Skirt 92' has shouldered portion 97' that extends outwardly from the skirt portion attached to wall 90, the skirt's shouldered portion enclosing the portions of spindle pads 164' and abrasive elements 300' that outwardly project from beneath wall 90.

Lower edge 95' of skirt 92' slidably engages floor F like lower edge 95 of skirt 92 does. The height of shouldered portion 97' is low enough (e.g., no more than about three to four inches) to be received in toe-kick spaces 400 of display cases, shelving units, cabinetry or other structure 402 resting on floor F. Thus, abrasive pads 300' can reach into these spaces 400 to permit concrete polishing operations on the floor therein using machine 20, substantially reducing the extent to which floor polishing procedures must be performed in toe-kick spaces 400 using hand-held tools, which tend to be labor-intensive and time-consuming.

Each of spindle assemblies 158 includes central spindle shaft 168 that extends along its axis 160 and about which its pulley 162 and spindle pad 164 rotate. Each spindle shaft 168 extends through turntable plate 144, 146, bearing structure 154, 156, and one of a pair of annular, left-hand and right-hand turntable ring gears 170, 172. Turntable gears 170, 172 are each concentric about its motor axis 104, 106, respectively, and fixed to its respective bearing structure 154, 156 through three spindle shafts 168, the ends of which are threaded. Relative to each bowl assembly 140, 142, apertures 174 are distributed at 120° increments about, and at a common radius from, central axis 104, 106, for receipt of spindle shafts 168 through plate 144, 146; bearing structure 154, 156; and turntable gear 170, 172. Relative to each bowl assembly 140, 142, nuts (not shown) are threadedly engaged with shafts 168 to retain the spindle assemblies, turntable plate, bearing structure, and annular turntable gear together.

Each of bowl assemblies 140, 142 is provided with belt tensioner assembly 176, 178 by which its spindle pulleys 162 are drivingly engaged with its respective motor drive pulley 166. Left-hand belt tensioner assembly 176 is provided within bowl assembly 140 beneath turntable plate 144, and is surrounded by cylindrical wall 148; right-hand belt tensioner assembly 178 is provided within bowl assembly 142 beneath turntable plate 146, and is surrounded by cylindrical wall 150. Each of left- and right-hand belt tensioner assemblies 176, 178 includes planar U-shaped bracket 180 having a pair of legs affixed to a central hub. Adjustment screw 182 is rotatably attached at one end to the bracket hub, and is threadedly received into the threaded bore of boss 184 mounted to the underside of each respective turntable plate 144, 146.

The legs of each U-shaped bracket 180 are provided with a pair of parallel slots 186, slots 186 also parallel with the longitudinal axis of its bracket's adjustment screw 182. Flanged bolt 188 extends through each of slots 186 and an aperture in turntable plate 144, 146, and is threadedly received in a tapped hole provided in bearing structure 154, 156, thereby retaining the legs of bracket 180 to the underside of turntable plate 144, 146, and guiding the direction of movement of bracket 180 relative to plate 144, 146 along slots 86. U-shaped bracket 180 slides freely relative to bolts 188 during adjustment of the belt with rotation of adjustment screw 182, and may be tightened against bracket 180 to hold it in place against turntable plate 144, 146.

Figure 16:
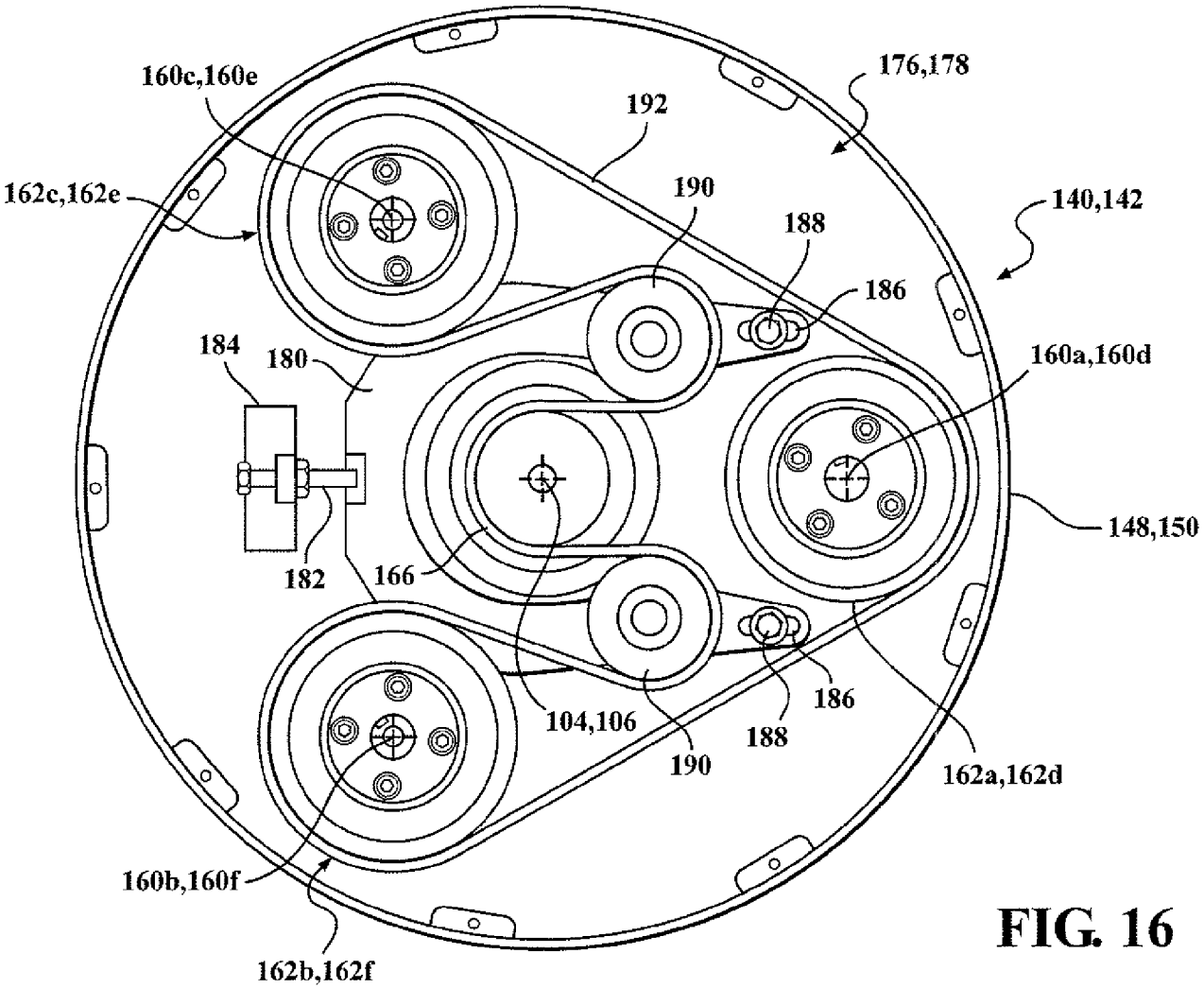
FIG. 16 is a bottom plan view of either bowl assembly of the machine, with its bottom cover and spindle pads removed, showing the drive belt and its belt tensioner assembly.

Tensioning rollers 190 are rotatably attached to the legs of each U-shaped bracket 180 and, with reference to FIG. 16, a serpentine belt 192 extends partially about spindle pulleys 162, drive pulley 166, and tensioning rollers 190 of each tensioner assembly 176, 178, in a manner known in the art.

Referring to FIGS. 11 and 12, left-hand turntable gear 170 is provided with at least one locking aperture 194 having axis 196 located radially outward of apertures 174 from axis 104. Left-hand locking mechanism 198 is mounted on surface 88 of shroud 86, and includes pin 200 that extends through plate 87 and is receivable in aperture 194 when pin longitudinal axis 202 and aperture axis 196 are coincident. With axes 196 and 202 so aligned, pin 200 is axially movable into aperture 194 to lock gear 170, and thus bowl assembly 140, against rotation relative to shroud 86. Similarly, right-hand turntable gear 172 is provided with at least one locking aperture 206 having axis 208, and right-hand locking mechanism 210 having pin 212 is mounted on surface 88. Pin 212 has longitudinal axis 214 and is receivable into gear locking aperture 206 when axes 214 and 208 are coincident to lock right hand bowl assembly 142 against rotation relative to shroud 86.

Locking apertures 194, 206 are circumferentially positioned about their respective ring gears 170, 172 to angularly fix one or both of bowl assemblies 140, 142 relative to shroud 86 so as to particularly position its or their spindles 158 relative to the shroud. For example, if only one bowl assembly 140 or 142 is to be fixed against rotation relative to shroud 86, it may be locked in a position that aligns two of its parallel spindle axes 160 in a direction perpendicular to imaginary plane 107, with its third axis 160 positioned in plane 107; left-hand bowl assembly 140 is so positioned in FIGS. 11 and 12, with its spindle pad 164*a* positioned adjacent the semicircular portion of shroud vertical wall 90. With bowl assembly 140 rotatably fixed relative to shroud 86, this position allows grinding edging along the left side of machine 20 in wide configuration 26 (by the tool 300 attached to spindle pad 164*a*) as close as ⅛ inch from the outside surface of shroud vertical wall 90, where it intersects plane 107. Right-hand bowl assembly 142 may be similarly fixed against rotation relative to shroud 86. The close-edging capabilities of machine 20 are discussed further below.

When bowl assembly 140 or 142 is fixed against rotation relative to shroud 86, planetary motion of its respective spindle assemblies 158 about its respective central axis 104, 106 is prevented, and each of the abrasive elements 300 of that bowl assembly rotates in place about its spindle pad's axis of rotation 160. In other words, the selective engagement of pin 200 or 212 into its respective turntable gear aperture 194, 206 prevents its bowl assembly 140, 142 from rotating relative to shroud 86, and causes its plurality of rotatable spindle assemblies 158 to rotate in place, relative to shroud 86, about their respective axes of rotation 160, with no planetary motion of these spindle assemblies 158 about its bowl assembly's central axis 104, 106.

When not fixed against rotation relative to shroud 86, bowl assemblies 140, 142 may be passively driven about its central axis 104 or 106 by the frictional engagement between rotating abrasive tools 300 and the floor F, and the rotatable spindle assemblies 158 of that bowl assembly 140, 142 revolve as satellites with planetary motion about its respective central axis 104, 106.

Permitting each bowl assembly 140, 142 to rotate about its respective axis 104, 106, and its rotating abrasive elements 300 to revolve as satellites about its axis 104, 106, defines an annular abrading area that has a radius of frictional engagement about axis 104, 106, each radius extending to the outermost circumferential portions of its respective abrasive pads 300. As best shown in FIG. 11, the radius of frictional engagement of left-hand bowl assembly 140 is defined by arrow 216 which extends from axis 104 to the outermost circumferential portions of spindle pads 164*a-c* and abrasive tools 300 attached thereto, the cutting surface of each abrasive elements 300 assumed to extend to the diameter of its respective spindle pad 164. Notably the radius indicated by arrow 216 extends well beyond circular rim 152 of cylindrical wall 148 of left-hand bowl assembly 140, but is contained within the adjacent semi-circular perimeter portion defined by shroud rim 94. Right-hand bowl assembly 142 similarly has a radius of frictional engagement from its central axis 106 indicated by arrow 218, which extends well beyond rim 152 of cylindrical wall 150. The radius of frictional engagement 216, 218 of each bowl assembly 140, 142 also extends to as close as about ⅛ inch from the outside surface of vertical wall 90 or skirt 92 in the semi-circular portions of shroud 86, thereby facilitating floor grinding and polishing cuts close to walls and other objects fixed relative to floor F.

The overlap between arrows 216 and 218 in and near plane 107 between axes 104 and 106 near the center of shroud 86, is about two inches. In other words, with bowl assemblies 140, 142, both permitted to be passively driven about their axes 104, 106 by the frictional engagement between their rotating abrasive tools 300 and floor F, an abrasion pattern is scratched in floor F that uninterruptedly extends substantially the entire length of shroud 86 in alignment direction 108. Because the frictional engagement radii of bowls 140, 142 centrally overlap, machine 20 can provide a continuous grinding or polishing cut along the length of shroud 86 (i.e., in the alignment direction 108), without the cut pattern having an uninterrupted portion therealong in which floor F is not abraded by a tool 300, even in wide configuration 26.

Base 22 is also provided with gear mechanism 223 that selectively rotatably couples right-and left-hand bowl assemblies 140, 142, and permits them to be rotated in unison, in opposite directions about their respective axes of rotation 104, 106, or to both be fixed against rotation relative to shroud 86 when either locking mechanisms 198, 210 is engaged with its respective turntable gear 170, 172. Gear mechanism 223 includes left-hand pinion or spur gear 224 having axis of rotation 226 and right-hand pinion or spur gear 228 having axis of rotation 230. Axes of rotation 226 and 230 are parallel and lie spaced in imaginary plane 231, which is substantially parallel with imaginary plane 107 that defines alignment direction 108. Spur gear 224 is provided with circumferentially distributed plurality of teeth 232 selectively engageable with circumferentially distributed plurality of teeth 234 on left-hand turntable gear 170. Circumferentially distributed plurality of teeth 236 on right hand spur gear 228 are permanently engaged with circumferentially distributed plurality of teeth 238 on right-hand turntable gear 172.

Teeth 232 on left-hand spur gear 224 selectively engage or disengage teeth 236 on right hand spur gear 228 and teeth 234 on left-hand turntable gear 170, through movement of left hand spur gear 224 along its axis 226 in and out of its engaged position. Left-hand spur gear 224 is provided with axially movable shaft 240 that extends along axis 226 through an aperture in shroud plate 87. The upper, terminal end of spur gear shaft 240 is provided with knob 242 that is manually manipulated by the operator through a push or pull motion along axis 226, towards and away from surface 88, to place left-hand spur gear 224 into and out of its engaged position, respectively.

If bowl assemblies 140, 142 are to both be rotatable relative to shroud 86, spindles 158 of bowl assemblies 140 and 142 are first preferably aligned to preclude the possibility of collision between any of spindle pads 164*a-c* with any of spindle pads 164*d-f*. With machine 20 preferably in its tilted configuration 250 (shown in FIGS. 17 and 18 and described further below), spindles 158 may be vertically arranged, left to right, in a 2-1-2-1 alignment, substantially as viewed in FIG. 12. Spur gear 224 is then moved along its axis 226 into its engaged position, rotatably coupling bowl assemblies 140, 142 together into fixed relative rotation. Thus, when bowl assemblies 140 and 142 rotate in unison, collision between their overlapping spindle pads 164, as spindles 158 approach each other near the center of shroud 86, is prevented. Bowl assemblies 140, 142 may also be so aligned when they are to both be fixed against rotation relative to shroud 86.

Therefore, with left-hand spur gear 224 in its engaged position, the left and right-hand bowl assemblies 140, 142 are rotatably coupled to one another such that they may either: both be fixed against rotation relative to shroud 86 via at least one of locking mechanisms 198, 210 as described above; or rotate in unison in opposite directions about their axes 104, 106, through the operatively coupled teeth of turntable gears 170, 172 and spur gears 224, 228.

It should thus be understood that with left-hand spur gear 224 in its engaged position, the relative speeds of rotation of bowl assemblies 140, 142 and, consequently, of the relative speeds of revolution of spindles 158 about axes 104 and 106, are fixed, although these speeds of bowl assembly rotation and spindle revolution may, together, be varied. The speeds of rotation of the spindles in each plurality of spindle assemblies 158*a-c* or 158*d-f* may, of course, be varied as to each plurality, which is independently driven by its drive pulley 166 rotatably fixed to the output shaft of its respective motor 100, 102.

In the engaged position of spur gear 224, if one or both of bowl assemblies 140, 142, is fixed against rotation relative to shroud 86 as described above, the other of bowl assemblies 140, 142 is then likewise rotatably fixed. With spur gear 224 out of its engaged position, one of left and right-hand bowl assemblies 140, 142 may be individually selectively fixed against rotation relative to shroud 86, and not permitted to rotate about its axis 104, 106 while the other of left and right-hand bowl assemblies 140, 142 is permitted to rotate. In this case, the spindles 158 of the rotatably fixed bowl assembly 140, 142 should be aligned such that two of its three parallel axes 160 are aligned in a direction perpendicular to plane 107, with the third axis 160 positioned within the space defined by the adjacent semi-circular portion of shroud 86, so as not to be in the planetary motion path of the spindles of the other, rotatable bowl assembly.

In the narrow or single-cut configuration(s) 28, the above-described structure provides a particular advantage over prior machines in that the forwardmost bowl assembly 140, 142 and the rearmost bowl assembly 140, 142 may be provided with abrasive tools 300 of differing grits. Thus, the forwardmost bowl assembly (e.g., bowl assembly 140 as shown) may be set up with abrasive tools 300 having a grit suitable for a grinding process (e.g., a grit number of 200 or lower), whereas the rearmost bowl assembly (e.g., bowl assembly 142 as shown) may be set up with tools 300 having a grit suitable for a polishing operation (e.g., a grit number of 400 or higher), or they may respectively be set up with abrasive pads 300 of grits used in immediate succession in the grinding or polishing process. The rotations about spindle axes 160 of the abrasive tools 300 in the forwardmost and rearmost bowl assemblies 140, 142 may be set at different speeds, if desired, via motor controls 66. As mentioned above, relatively higher speeds are generally preferred for grinding operations, and relatively slower speeds are generally preferred for polishing operations. Additionally, both or either of bowl assemblies 140, 142 individually, may be relatively fixed against rotation relative to shroud 86, or they may rotate in unison as described above.

For example, in the depicted narrow or single-cut configuration 28, the forwardmost bowl assembly 140 may be fixed against rotation about axis 104 relative to shroud 86, and its relatively lower grit numbered abrasive tools 300 rotated in place relative to shroud 86 at a relatively higher speed and clockwise about their respective axes 160*a-c*, to perform a grinding step; whereas the rearmost bowl assembly 142 is permitted to rotate about axis 106 relative to shroud 86, and its relatively higher grit numbered abrasive tools 300 rotated at a relatively lower speed and counterclockwise about their axes 160*d-f* as spindles 158*d-f* revolve as satellites about axis 106, to perform a polishing step; these different, exemplary steps of the grinding and polishing process being performed simultaneously. Various combinations of other spindle speeds and rotation directions, tool grits, and bowl assembly rotations may be envisioned, and can be realized with machine 20.

Machine 20 thus provides significant advantages over prior grinding and polishing machines in that a variety of different steps of the grinding and polishing process may be concurrently performed using the same machine, and by a single operator, with attendant cost savings, and improved flexibility.

Figure 17:
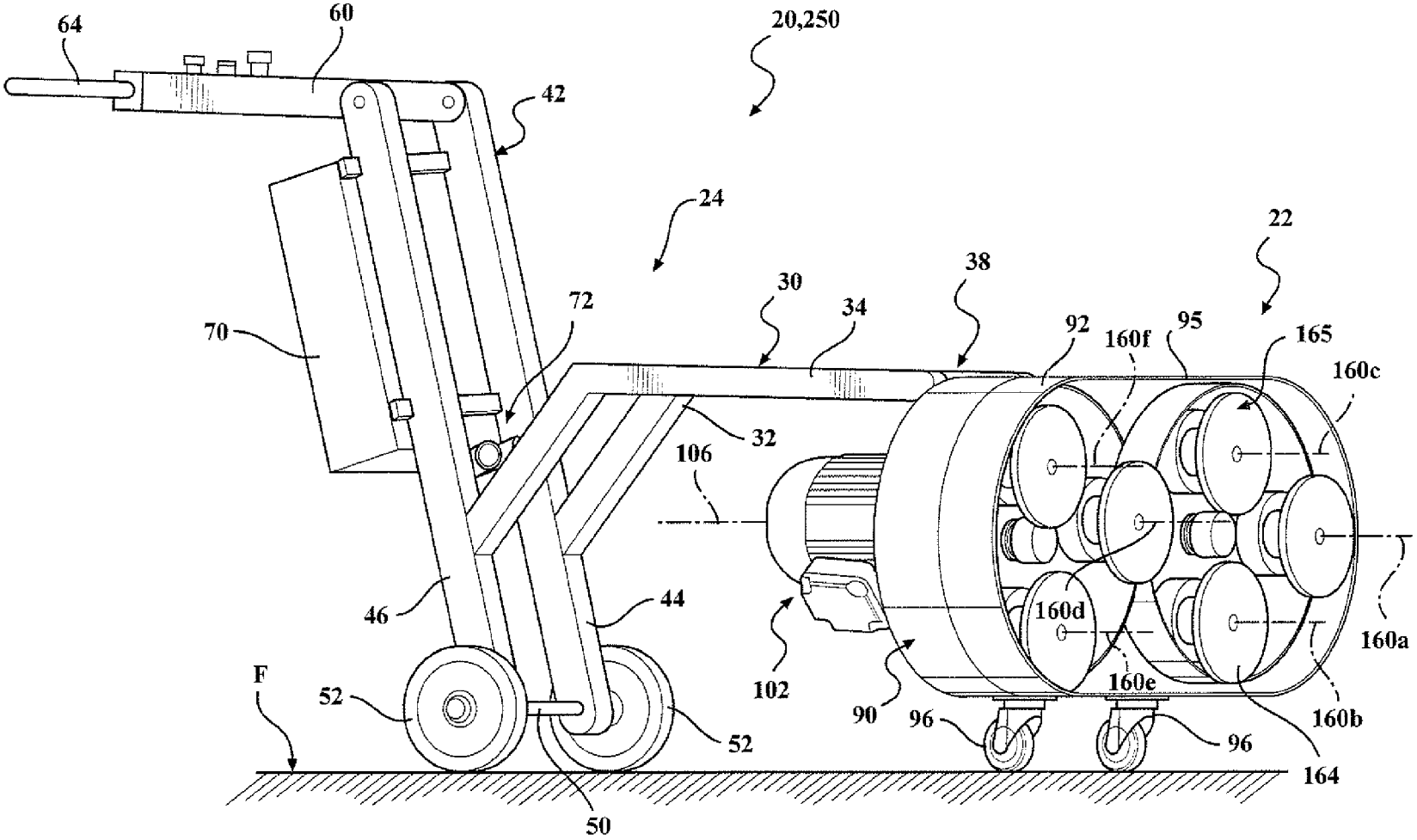
FIG. 17 is a right-front perspective view of the machine in its tilted configuration.
Figure 18:
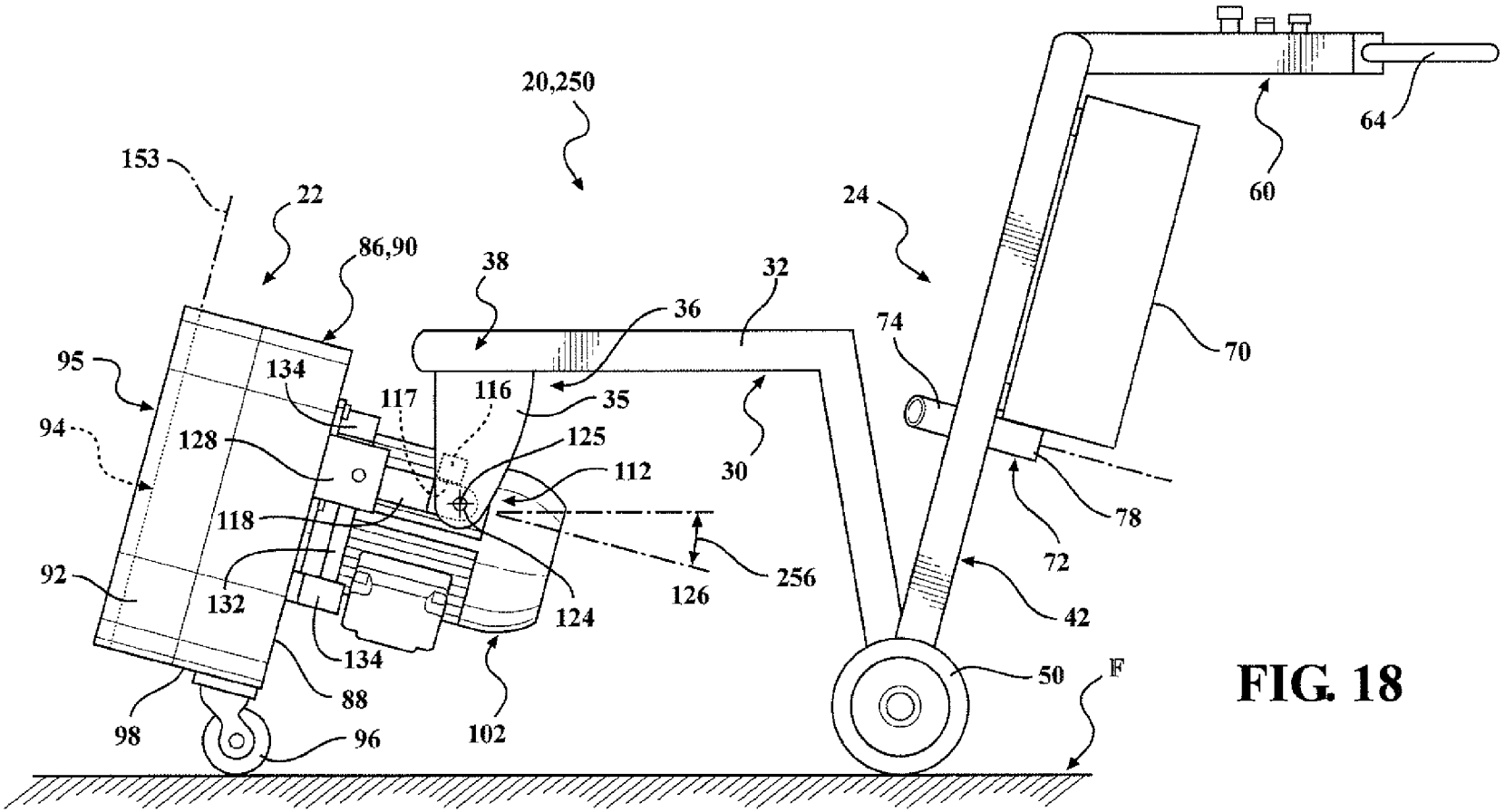
FIG. 18 is a side view of the machine configured as in FIG. 17, with one of its electric motors removed for clarity.

Referring now to FIGS. 17 and 18, machine 20 can be moved out of the floor-engaging position (shown in FIGS. 1-5) and into tilted configuration 250 which exposes the underside of shroud 86 by placing base 22 out of a floor-engaging position. In tilted configuration 250, spaced casters 96 are brought into contact with floor F for rolling transport of machine 20, removing and replacing tools 300, or performing repair and maintenance. In reconfiguring machine 20 from wide configuration 26 to tilted configuration 250, base 22 is first lifted from floor F, through shaft 118 and clevis 36, by rocking machine 20 back on wheels 52 by the operator applying a downward force on grip 64. Base 22 is then rotated relative to handle 24 about lynchpin or tilt axis 125 until the forward-facing surface of shaft 118 abuts stop surface 117 of clevis stop member 116. With shaft 118 in contact with stop surface 117, axis 126 of shaft 118 is oriented at an angle 256 relative to horizontal about tilt axis 125, such that an over-center effect is achieved that stably holds machine 20 in its tilted configuration 250, supported on floor F by wheels 52 and casters 96. In tilted configuration 250, the machine may be easily rolled on casters 96 and wheels 52. As shown in FIG. 17, in the tilted configuration 250, the underside opening of shroud 86 defined by rim 94 is fully open to the front of machine 20 and abrasive tools 300 are fully accessible for removal and replacement.

Cover 258, having apertures 260 through which portions of spindle assemblies 158 extend, is removably attached to each cylindrical wall 148, 150 of bowl assemblies 140, 142, to close the circular openings defined by their circular bottom edges 152, and shield belts 192 and belt tensioner assemblies 176, 178 from dust and debris. Covers 258 are disposed along bowl assembly central axes 104, 106 above spindle pads 164, and their apertures 160 closely encircle, with a small clearance, a portion of each spindle 158 located above its spindle pad 164.

Tools 300, spindle pads 164 and covers 258 are removed to provide access to belt tensioner assemblies 176, 178 for adjustment or replacement of belt 192. In this procedure, abrasive pads 300 are first removed from spindle pad surfaces 165 in a known manner, and then spindle pads 164 are removed from the rest of spindles 158 in a known manner. Cover 258 is then removed from wall 148, 150, to which it is attached by, for example, retaining screws (not shown), or by other known means. Belt 192 is adjusted or replaced, and cover 258, spindle pads 164, and abrasive tools 300 are then reassembled.

The invention has been described in an illustrative manner, and it is to be understood that the terminology which has been used is intended to be in the nature of words of description rather than of limitation. It is now apparent to those skilled in the art that many modifications and variations of the present invention are possible in light of the above teachings. It is, therefore, to be understood that the invention may be practiced otherwise than as specifically described.

What is claimed is:

1. A floor grinding and polishing machine comprising:

a base including;

a shroud, first and second spindle carriers rotatably coupled to said shroud and having first and second axes of rotation relative to said shroud, respectively, said first and second spindle carrier axes of rotation substantially parallel and spaced from each other in an alignment direction relative to said base, first and second pluralities of rotatable spindles, each said spindle having an axis of rotation and capable of drivably supporting a floor-engaging abrasive tool, said first plurality of spindles carried by said first spindle carrier and distributed about said first spindle carrier axis of rotation, said second plurality of spindles carried by said second spindle carrier and distributed about said second spindle carrier axis of rotation, and first and second motors connected to said shroud and drivingly engaged with said first and second pluralities of spindles, respectively, whereby said spindles of each said first and second plurality of spindles are rotatably driven about their respective said axes of rotation by their respective said motor; and a floor-engaging handle coupled to said base and providing an interface between said machine and an operator in control of said machine, said handle defining a direction of operative movement along which said machine may linearly travel relative to the floor;

said base having different first and second selective positions relative to said handle in which said alignment direction and said direction of operative movement are at substantially different angular positions relative to each other.

2. The invention of claim 1, wherein said base has selective first and second positions relative to said handle in which said machine has a wide configuration in which said alignment direction and said direction of operative movement are substantially perpendicular and a narrow configuration in which said alignment direction and said direction of operative movement are substantially parallel, respectively.

3. The invention of claim 1, wherein said base and said handle are pivotably coupled about a pivot axis and selectively lockable into one of a plurality of different angular orientations relative to each other about said pivot axis.

4. The invention of claim 3, wherein said pivot axis is substantially parallel with said spindle carrier axes of rotation.

5. The invention of claim 1, wherein at least one of said spindle carriers is selectively fixed against rotation relative to said shroud.

6. The invention of claim 1, wherein said spindle carriers are selectively rotatably coupled to each other, the angular movement of one of said spindle carriers about its respective said axis of rotation being dependent upon the angular movement of the other of said spindle carriers about its respective said axis of rotation when said spindle carriers are rotatably coupled to each other.

7. The invention of claim 6, wherein angular movements of said first and second spindle carriers relative to said shroud are in opposite directions about their respective axes of rotation.

8. The invention of claim 6, wherein angular movement of said one spindle carrier about its respective axis of rotation is independent of angular movement of said other spindle carrier about its respective axis of rotation when said spindle carriers are rotatably uncoupled from each other.

9. The invention of claim 6, wherein each said spindle carrier has a set of circumferentially distributed gear teeth that are operatively engaged when said first and second spindle carriers are rotatably coupled to each other.

10. The invention of claim 9, further comprising a pinion gear having an axis of rotation substantially parallel with said spindle carrier axes of rotation, said pinion gear having an engaged position into which said pinion gear is selectively positioned and in which said gear teeth of said first and second spindle carriers are operatively engaged through said pinion gear.

11. The invention of claim 10, wherein said pinion gear is selectively positioned into and out of said engaged position along said pinion gear axis of rotation.

12. The invention of claim 1, wherein at least one said spindle carrier is rotatably urged about its said axis of rotation by its respective said plurality of spindles, the revolution of said spindles about said spindle carrier axis of rotation imparted by frictional engagement between the floor and abrasive elements drivably supported by said spindles.

13. The invention of claim 1, wherein rotation of at least one of said first and second spindle carriers is urged by planetary movement of at least one of said first and second pluralities of spindles about its respective spindle carrier axis of rotation, said planetary movement being imparted by frictional engagement between the floor and floor-engaging tools drivably supported by said spindles of said at least one of said first and second pluralities of rotatable spindles.

14. The invention of claim 1, wherein said first and second pluralities of spindles are capable drivably supporting floor-engaging tools that are of differing abrasive grits.

15. A method of using a floor grinding and polishing machine according to claim 1, including the steps of:

positioning the machine in its narrow configuration such that the first spindle carrier is positioned forward of the second spindle carrier relative to the direction of operative movement;

drivably supporting floor-engaging tools having a first abrasive grit number with the first plurality of spindles; and drivably supporting floor-engaging tools having a second abrasive grit number with the second plurality of spindles, the second abrasive grit number being numerically greater than the first abrasive grit number.

16. The invention of claim 15, further comprising the steps of:

fixing the first spindle carrier but not the second spindle carrier against rotation relative to the shroud; and performing floor grinding steps and floor polishing steps substantially simultaneously with the tools drivably supported on the first and second pluralities of spindles of the machine, respectively.

17. A floor grinding and polishing machine comprising:

a base comprising;

a shroud, first and second spindle carriers rotatably coupled to said shroud and having first and second axes of rotation relative to said shroud, respectively, said axes of rotation spaced along an alignment direction relative to said base, said spindle carriers each comprising a gear concentric about its respective said axis of rotation, a plurality of spindles rotatably attached to each said spindle carrier, each said spindle capable of drivingly supporting a floor-engaging abrasive tool, each said spindle carrier having selective permitted and prevented rotational movement relative to said shroud, said plurality of spindles having planetary movement about said axis of rotation during said rotational movement, said gears of said first and second spindle carriers selectively rotatably coupled together, rotations of said first and second spindle carriers about their respective axes of rotation being interdependent when said spindle carrier gears are rotatably coupled and independent when said spindle gears are not rotatably coupled; and a handle pivotably coupled to said base and defining a direction of operative movement of said machine in which said machine has linear travel relative to the floor, said handle and base having relative angular movement about a pivot axis between angularly spaced positions in which said alignment direction and said direction of operative movement are changeable between substantially perpendicular and substantially parallel.

18. A floor grinding and polishing machine comprising:

a base including;

a shroud, said shroud defining a space and having a rim that defines an opening to said space, first and second spindle carriers rotatably coupled to said shroud and having first and second axes of rotation relative to said shroud, respectively, said first and second spindle carrier axes of rotation substantially parallel and spaced from each other in an alignment direction relative to said base, first and second pluralities of rotatable spindles, each said spindle having an axis of rotation and capable of drivably supporting a floor-engaging abrasive tool, said first plurality of spindles carried by said first spindle carrier and distributed about said first spindle carrier axis of rotation, said second plurality of spindles carried by said second spindle carrier and distributed about said second spindle carrier axis of rotation wherein the path of travel of the first plurality of spindles overlaps the path of travel of the second plurality of spindles, first and second motors connected to said shroud and drivingly engaged with said first and second pluralities of spindles, respectively, whereby said spindles of each said first and second plurality of spindles are rotatably driven about their respective said axes of rotation by their respective said motor; and said machine having an operating configuration in which said first and second axes of rotation extend substantially vertically towards the floor and said space is substantially enclosed, and a nonoperating configuration in which said first and second axes of rotation extend substantially nonvertically and said space is substantially nonenclosed, whereby access to said space is provided through said opening; and a floor-engaging handle by which an operator may controllably engage said machine, said handle pivotably coupled to said base about a tilt axis and having first and second relative positions about said tilt axis in which said machine is in said operating and nonoperating configurations, respectively.

19. The invention of claim 18, wherein said machine is supported for rolling transport in said nonoperating configuration.

20. The invention of claim 19, wherein said handle is in wheeled engagement with the floor, and wherein said base further comprises a pair of spaced casters on which said machine is partially supported in said nonoperating configuration, said castes positioned out of contact with the floor in said operating configuration.

* * * * *

UNITED STATES PATENT AND TRADEMARK OFFICE

CERTIFICATE OF CORRECTION

PATENT NO. : 8,684,796 B2
APPLICATION NO. : 13/252771
DATED : April 1, 2014
INVENTOR(S) : Travis McCutchen et al.

It is certified that error appears in the above-identified patent and that said Letters Patent is hereby corrected as shown below:

IN THE CLAIMS:

Column 19, line 25, please delete "said castes positioned" and replace with --said casters positioned--

Signed and Sealed this
Fifth Day of August, 2014

Michelle K. Lee

Michelle K. Lee
*Deputy Director of the United States Patent and Trademark Office*